US008033145B2

(12) United States Patent
Komori

(10) Patent No.: US 8,033,145 B2
(45) Date of Patent: Oct. 11, 2011

(54) DRUM-TYPE WASHING MACHINE

(75) Inventor: Masanori Komori, Matsubara (JP)

(73) Assignee: Sharp Kabushiki Kaisha, Osaka (JP)

( * ) Notice: Subject to any disclaimer, the term of this patent is extended or adjusted under 35 U.S.C. 154(b) by 909 days.

(21) Appl. No.: 11/570,434

(22) PCT Filed: May 8, 2006

(86) PCT No.: PCT/JP2006/309225

§ 371 (c)(1),
(2), (4) Date: Dec. 12, 2006

(87) PCT Pub. No.: WO2006/120988

PCT Pub. Date: Nov. 16, 2006

(65) Prior Publication Data

US 2008/0282746 A1 Nov. 20, 2008

(30) Foreign Application Priority Data

May 13, 2005 (JP) ..... 2005-140468

(51) Int. Cl.
*D06F 29/00* (2006.01)

(52) U.S. Cl. ..... 68/23.2; 68/23 R; 68/23.1; 68/24; 8/158; 8/159

(58) Field of Classification Search ..... 68/24, 25, 68/23.2; 8/158, 159
See application file for complete search history.

(56) References Cited

U.S. PATENT DOCUMENTS

| | | | | |
|---|---|---|---|---|
| 2,260,518 | A * | 10/1941 | Nicholson et al. | 134/110 |
| 2,645,548 | A * | 7/1953 | Kreitchman et al. | 312/351 |
| 5,906,056 | A * | 5/1999 | Noguchi et al. | 34/596 |
| 6,557,383 | B1 * | 5/2003 | Ito et al. | 68/23.2 |
| 6,615,619 | B2 * | 9/2003 | Kakuda et al. | 68/24 |
| 7,310,978 | B2 * | 12/2007 | Hisano | 68/23.1 |
| 7,886,391 | B2 * | 2/2011 | Shikamori et al. | 8/158 |
| 2002/0020196 | A1 * | 2/2002 | Kakuda et al. | 68/12.06 |
| 2004/0016266 | A1 * | 1/2004 | Hisano | 68/23.1 |
| 2004/0244438 | A1 * | 12/2004 | North | 68/23.2 |
| 2006/0101871 | A1 * | 5/2006 | Inuzuka et al. | 68/23 R |
| 2007/0137260 | A1 * | 6/2007 | Shikamori et al. | 68/3 R |

FOREIGN PATENT DOCUMENTS

| | | |
|---|---|---|
| CN | 1566466 | 1/2005 |
| JP | 48-10354 | 4/1973 |
| JP | 60-171281 | 11/1985 |
| JP | 2000-262796 | 9/2000 |
| JP | 2000-271380 | 10/2000 |
| JP | 2003-079995 | 3/2003 |

OTHER PUBLICATIONS

International Search Report for corresponding Application No. PCT/JP2006/309225, mailed Aug. 15, 2006.

* cited by examiner

*Primary Examiner* — Michael Kornakov
*Assistant Examiner* — Katelyn Whatley
(74) *Attorney, Agent, or Firm* — Renner, Otto, Boisselle & Sklar, LLP

(57) ABSTRACT

While a damper elastically supports, from below, the center of gravity of a water tub, a suspender also elastically supports it, from above, by suspending a front part of the water tub rearward-upward and a rear part thereof frontward-upward. Even when a rated capacity of laundry is put into a drum, although the damper simply elastically supports the center of gravity of the structural load from below, the water tub is prevented from sinking too far, and a door gasket is saved from being damaged from overdeformation.

13 Claims, 14 Drawing Sheets

DRUM-TYPE WASHING MACHINE

TECHNICAL FIELD

The present invention relates to a drum-type washing machine.

BACKGROUND ART

Drum-type washing machines are widely used especially in Europe. Commercially available drum-type washing machines typically perform a laundering process, including a washing process and a rinsing process, in both of which a rotary drum is rotated at low speed, and a spin-drying process, in which the rotary drum is rotated at high speed, often followed by a air-drying process.

FIGS. 13 and 14 show a conventional drum-type washing machine. FIG. 13 is a vertical cross-sectional view of the conventional drum-type washing machine as seen from a side, and FIG. 14 is a vertical cross-sectional view of the conventional drum-type washing machine as seen from the same side but at a different cross-section. A cabinet 201 has, open in a front face thereof, a laundry opening 201*a* that can be opened and closed with a door 202. Inside the cabinet 201, a cylindrical water tub 203 is provided that has a water tub opening 203*a* open toward the laundry opening 201*a*. With respect to a horizontal axis, the cylinder axis of the water tub 203 is so inclined as to be increasingly low rearward. The laundry opening 201*a* and the water tub opening 203*a* are connected together by a tubular connecting member 204 that forms a watertight passage between them. The connecting member 204 has part thereof formed into a bellows portion 204*a* that makes the vibrations of the water tub 203 less likely to conduct to the cabinet 201.

Inside the water tub 203, a cylindrical drum 205 is provided that has a drum opening 205*a* open toward the water tub opening 203*a*. With respect to a horizontal axis, the cylinder axis of the drum 205 is so inclined as to be increasingly low rearward. All over the cylindrical circumferential surface of the drum 205, a large number of small holes 205*b* are formed. Through the small holes 205*b*, air and liquid pass between inside the water tub 203 and inside the drum 205. On the inner wall surface of the drum 205, baffles 205*c* are provided that protrude toward the cylinder center axis of the drum 205.

From the center of the rear surface of the drum 205, a drum shaft 205*d* protrudes rearward. The drum shaft 205*d* is fitted so as to penetrate the rear surface of the water tub 203, and is, via a bearing 207, rotatably supported on a bearing housing 206. The drum 205 is coupled, via the drum shaft 205*d*, directly to a motor 208 fitted on the rear surface of the water tub 203. As the motor 208 is driven, the drum 205 is driven to rotate.

In a front part of the drum 205, a balancer 209 is provided that has a movable material sealed therein. The balancer 209 reduces the swings of the drum 205 when it is driven, and thus contributes to reduced generation of vibrations. The balancer 209 itself is a weighty member, and thus contributes to an enhanced rotation balance.

At a bottom part of the water tub 203, as shown in FIG. 14, a water drain duct 210, a water drain valve 211, and a water drain hose 212 are provided. When the water drain valve 211 is opened, water inside the water tub 203 is drained out of the cabinet 201 via the water drain duct 210 and the water drain hose 212.

Over a rear to upper and to front part of the water tub 203, a warm air feeding device 213 is provided. The warm air feeding device 213 includes a warm air return port 214, a heat exchanger 215, a coupling duct 216, a fan device 217, a duct 218, a heating device 219, and a duct 220. One end of the duct 220 is connected to a warm air discharge port 204*b* formed in the connecting member 204, so as to lead into the water tub 203. During an air-drying operation, the warm air feeding device 213 sucks in the air inside the water tub 203 via the warm air return port 214, and circulates it through the heat exchanger 215, the coupling duct 216, the fan device 217, the duct 218, the heating device 219, and the duct 220 to return it, via the warm air discharge port 204*b*, into the water tub 203. In this way, the air inside the water tub 203 is warmed and is subjected to heat exchange (dehumidification).

Moreover, as shown in FIG. 13, at a front upper part of the water tub 203, a counterweight 221 is fitted, and, at a front lower part of the water tub 203, another counterweight 222 is fitted. These counterweights 221 and 222 are for adjusting the center of gravity of a structural load 223, which will be described later. By varying the weights of the counterweights 221 and 222 and the fitting positions thereof on the water tub 203, it is possible to easily vary the center of gravity and the weight of the structural load 223, leading to higher freedom in design.

The water tub 203 is supported inside the cabinet 201 by suspensions 224, restricting springs 225 and 227, and a coupling member 226. The suspensions 224, of which one is provided at the left side and the other at the right side, supports the water tub 203 from below. The restricting spring 225, which is a tension coil spring, applies a front/rear-direction tensile force between a front upper part of the water tub 203 and a front upper part of the cabinet 201. The restricting spring 227, which also is a tension coil spring, applies a front/rear-direction tensile force between the coupling member 226, which is fixed to a middle upper part of the cabinet 201, and a front upper part of the water tub 203.

Here, the suspensions 224 and the restricting springs 225 and 227 bear the structural load 223 of, and thereby support, the following components: the water tub 203, the drum 205, the drum shaft 205*d*, the bearing housing 206, the bearing 207, the motor 208, the balancer 209, the heat exchanger 215, the duct 216, the fan device 217, the duct 218, the heating device 219, the duct 220, and the counterweights 221 and 222. The two, left and right, suspensions 224 support the water tub 203 at one position in the front/rear direction, and are located substantially at the center of gravity g of the structural load 223 in the front/rear direction.

Different processes included in a laundering process, namely a washing process, a rinsing process, and a spin-drying process, and also an air-drying process, are all performed by driving with the motor 208 the drum 205 to rotate, with the drum 205 in a state containing a laundering load 228, which includes laundry put into the drum 205 as articles to be processed plus washing water to be used to process the laundry. In a washing process, the motor 208 is driven to rotate intermittently, alternately in the forward and reverse directions, at comparatively low rotation speed so that the drum 205 rotates intermittently, alternately in the forward and reverse directions. In the spin-drying process, the motor 208 is driven to rotate continuously in one direction at high rotation speed so that the drum 205 rotates at high speed.

In the drum-type washing machine constructed as described above, when the drum 205 is driven to rotate in a washing process, the suspensions 224 are located substantially at the center of gravity g of the structural load 223, resulting in a good rotation balance. Moreover, the provision of the restricting springs 225 and 227, which elastically restrict the front/rear-direction swings of the structural load 223, helps reduce the front/rear-direction swings of the structural load 223, effectively reducing the vibrations generated in the cabinet 201.

[Patent Publication 1] JP-A-2000-262796

DISCLOSURE OF THE INVENTION

Problems to be Solved by the Invention

The drum-type washing machine described above, however, has the following disadvantages. In a washing process or spin-drying process, the center of gravity g' of the laundering load 228 placed inside the drum 205 is located in front of and in addition below the center of gravity g of the structural load 223. Hence, the center of gravity G of the body of mass constituted by the structural load 223 and the laundering load 228 considered together, referred to as the vibrating body load 229, is located in front of the suspensions 224. Thus, as the weight of the laundering load 228 increases, the part of the water tub 203 located in front of where it is supported by the suspensions 224 tends more to be displaced downward and accordingly the part of the water tub 203 located behind where it is supported by the suspensions 224 tends more to be displaced upward. That is, in the side cross-sectional view of FIG. 13, the water tub 203 tends to rotate counter-clockwise about where it is supported by the suspensions 224. Continuing to perform washing, rinsing, spin-drying, and air-drying processes in this state makes the connecting member 204 more likely to be damaged from overdeformation, and makes the connecting member 204 more likely to propagate the vibrations of the water tub 203 to the cabinet 201.

With the restricting springs 225 and 227 fitted as they are in this drum-type washing machine, it is difficult to prevent the counter-clockwise rotation of the water tub 203 about the suspensions 224 in FIG. 13, in particular, the downward displacement of the front part of the water tub 203. One way to reduce the downward displacement of the front part of the water tub 203 is to increase the spring constants of the restricting springs 225 and 227. This disadvantageously increases the influence of the vibrations of the water tub 203 propagated via the restricting springs 225 and 227 to the cabinet 201. Moreover, in a front upper part of the cabinet 201, an extra space is needed for the coupling of the restricting spring 225. This disadvantageously restricts the freedom allowed in the exterior shape of the front upper part of the cabinet 201.

One way to reduce the front/rear-direction shift of the center of gravity of the vibrating body load 229 attributable to the laundering load 228 is to increase the weight of the counterweight 222 provided at the front part of the water tub. This helps shift the center of gravity g of the structural load 223 frontward so that the line passing through both the center of gravity g of the structural load 223 and the center of gravity g' of the laundering load 228 runs in the up/down direction in FIG. 13; providing the suspensions 224 on a vertical line passing through the center of gravity g is expected to reduce the counter-clockwise rotation of the water tub 203 about where it is supported by the suspensions 224. With the weight of the counterweight 222 increased, however, this disadvantageously increases the weight and cost of the product.

Means for Solving the Problem

To overcome the disadvantages discussed above, a drum-type washing machine according to the present invention is provided with: a cabinet having a cabinet opening open between inside and outside the cabinet; a water tub arranged inside the cabinet and having a water tub opening open toward the cabinet opening; a drum contained inside the water tub and having a drum opening open toward the water tub opening; a motor for driving the drum to rotate; a suspending device for elastically supporting, from above, the water tub inside the cabinet; and a damping device for elastically supporting, from below, the water tub inside the cabinet. Here, the suspending device has a suspender (first suspender) that supports, by suspending upward-rearward, the front part of the water tub located in front of the position where the water tub is supported by the damping device. With this construction, the sinking, i.e. downward displacement, of the front part of the water tub inside the cabinet, as inconveniently experienced when a laundering load is put in, can be effectively prevented.

Preferably, the suspending device further has another suspender (second suspender) that supports, by suspending upward-frontward, the rear part of the water tub located behind the position where the water tub is supported by the damping device. With this construction, not only can the sinking of the front part of the water tub inside the cabinet be prevented, also the floating, i.e. upward displacement, of the front part of the water tub inside the cabinet can be effectively prevented. Preferably, the water tub opening and the cabinet opening are located away from each other without being directly coupled together by any member. With this construction, while the sinking of the front part of the water tub inside the cabinet is prevented, the propagation of vibrations from the water tub to the cabinet can be reduced.

In the drum-type washing machine according to the present invention, preferably, with respect to differently defined loads—namely, the structural load composed of the water tub, the drum, and the motor and elastically supported inside the cabinet by the suspending device and the damping device; the laundering load composed of laundry, having a rated weight and placed inside the water tub, and washing water; and the vibrating body load composed of the structural load and the laundering load—the damping device supports between the center of gravity of the structural load and the center of gravity of the vibrating body load. With this construction, the influence of the variation of the laundering load on the sinking of the front part of the water tub inside the cabinet can be minimized. Preferably, the damping device supports at the center of gravity of the structural load, or supports at the center of gravity of the vibrating body load. With these constructions, the suspension that supports the front or rear part of the water tub can be replaced with one having a weaker tensile power, or can be omitted altogether.

In the drum-type washing machine according to the present invention, preferably, the damping device has, in addition to a damper (first damper) that supports the water tub by pressing it upward, another damper (second damper) that supports, by pressing upward, the front part of the water tub located in front of the position where the water tub is supported by the first damper. With this construction, the rotation, i.e. rotational displacement, of the water tub about where it is supported by the first damper can be prevented. Preferably, the second damper supports at a position in front of the center of gravity of the vibrating body load. With this construction, the sinking of the front part of the water tub inside the cabinet, as inconveniently experienced when a laundering load is put in, can be surely prevented.

In the drum-type washing machine according to the present invention, preferably, the portion at which the first suspender is fitted to the water tub is located in a front-face part thereof. With this construction, with a suspender having a weak tensile power, the sinking of the front part of the water tub inside the cabinet can be prevented. Preferably, the portion at which the first suspender is fitted to the cabinet is located in front of the center of gravity of the vibrating body load. Preferably, the first and second suspenders are so arranged that, with respect to a horizontal plane, the axis of direction in which the first suspender supports forms a larger angle than the axis of direction in which the second suspender supports, or alternatively, the first suspender has a greater spring constant than the second suspender. With these constructions, with suspenders having given tensile powers, the sinking of the front part of the water tub inside the cabinet can be prevented more effectively.

In the drum-type washing machine according to the present invention, preferably, the first suspender or the second damper has a stopper that prevents the front part of the water tub from being displaced downward beyond a predetermined distance. Preferably, the stopper functions as a result of mutual contact among adjacent turns of wire forming a coil spring included in the first suspender or the second damper. With these constructions, the contact between the water tub and the cabinet resulting from the sinking of the water tub can be prevented. Preferably, the cabinet has a soft member provided at a lower-edge part of the cabinet opening. With this construction, even if the water tub and the cabinet make contact with each other, no unusual noise is produced, and the water tub and the cabinet are prevented from being damaged or scratched.

In the drum-type washing machine according to the present invention, preferably, at least one of the portions at which the damping device and the suspending device are fitted to the water tub is formed integrally therewith. With this construction, the number of components and the cost can be reduced. Preferably, the portions at which the suspending device is fitted to the cabinet are arranged in a row along the left/right direction. With this construction, the portions at which the suspensions are fitted to the cabinet can be made compact and lightweight.

Advantages of the Invention

According to the present invention, it is possible to effectively prevent the front part of the water tub from being displaced downward or upward when the laundering load is put in.

DESCRIPTION OF THE REFERENCE DESIGNATIONS

Figure 1:
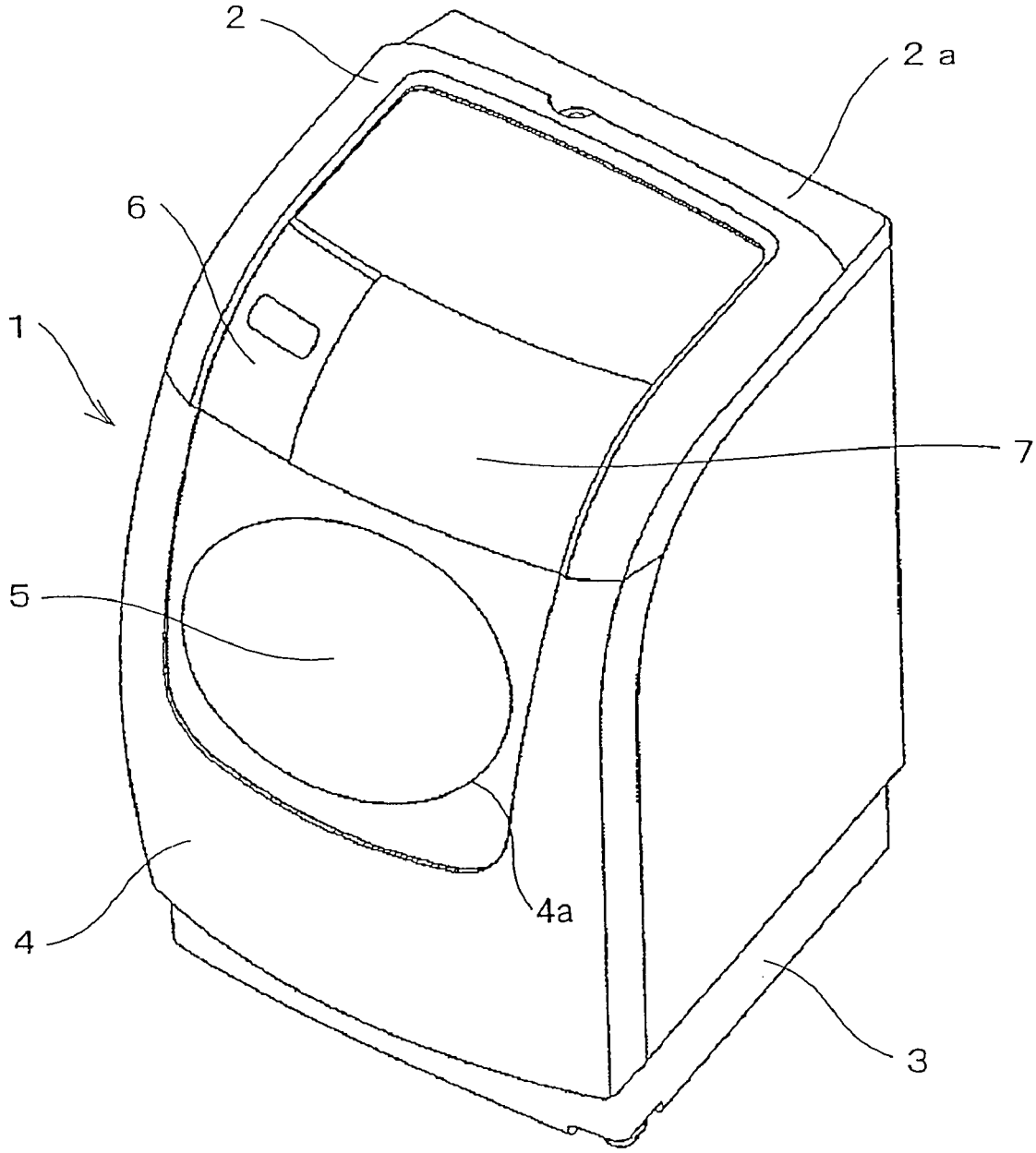
FIG. 1 A schematic exterior perspective view of the drum-type washing machine of a first embodiment of the present invention.

1, 60: cabinet
2: top plate
2*a*: depressed portion
3: bottom stand
4, 61: body
4*a*, 61*a*: cabinet opening
5, 62: door
6: detergent case
7: operation panel
8: control circuit
9: tap water feed port
10: bath water feed port
11: water feed pipe
12: water feed container
13: water feed duct
14: water feed valve
15: bath water pipe
16: bath water pump
17: suspension fitting portion
18, 19, 72, 73, 84, 85, 97, 98, 99: damper fitting portion
20, 63, 74, 86, 100, 108: water tub
21, 64: front part
21*a*, 64*a*: water tub opening
22, 75, 87, 101: rear part
23, 23', 24, 24', 25, 67, 67', 68, 68', 76, 88, 102: suspension fitting portion
26, 27, 77, 78, 89, 90, 103, 104, 105: damper fitting portion
28: door gasket;
28*a*: bellows portion
28*b*: seal portion
29, 25: screw
30: water drain duct
31: filter unit
32: water drain hose
33: water drain valve
34: drum
34*a*: drum opening
34*b*: small hole

34*c*: baffle
34*d*: drum shaft
36: motor
36*a*: motor cover
36*b*: bearing
36*c*: rotor
36*d*: stator
37: liquid balancer
40: heater portion
40*a*: heater cover
40*b*: heater
41: heat exchange plate
42: blowing fan
50, 51, 96: damper
50*a*, 50*b*, 51*a*, 51*b*, 96*a*, 96*b*: elastic member
96*c*: cylinder
96*d*: piston
96*e*: coil spring
52, 53, 54, 79, 80, 81, 91, 92, 93: suspension
52*a*, 52*b*: connecting portion
52*c*: cylinder
52*d*: flange portion
52*e*: coil spring
55, 70, 82, 94, 106, 109: structural load
56 laundering load
57, 71, 83, 95, 107, 110: vibrating body load
61*b*: slide groove
65: water tub door
66: seal member
201: cabinet
201*a*: laundry opening
202: door
203: water tub
203*a*: water tub opening
204: connecting member
204*a*: bellows portion
204*b*: warm air discharge port
205: drum
205*a*: drum opening
205*b*: small hole
205*c*: baffle
205*d*: drum shaft
206: bearing housing:
207: bearing
208: motor
209: balancer
210: water drain duct
211: water drain valve
212: water drain hose
213: warm air feeding device
214: warm air return port
215: heat exchanger
216: coupling duct
217: fan device
218: duct
219: heating device
220: duct
221, 222: counterweight
223: structural load
224: suspension
225, 227: restricting spring
226: coupling member
228: laundering load
229: vibrating body load
P1 to P12: connecting position
g, g1, g3 to g7: center of gravity of the structural load
g': center of gravity of the laundering load
g2: center of gravity of the laundering load, with laundry having the rated weight
G: center of gravity of the laundering load
G1 to G6: center of gravity of the vibrating body load, with laundry having the rated weight
θ1 to θ12: angle
C.L.: cylinder axis of the drum

BEST MODE FOR CARRYING OUT THE INVENTION

First Embodiment of the Present Invention

Figure 2:
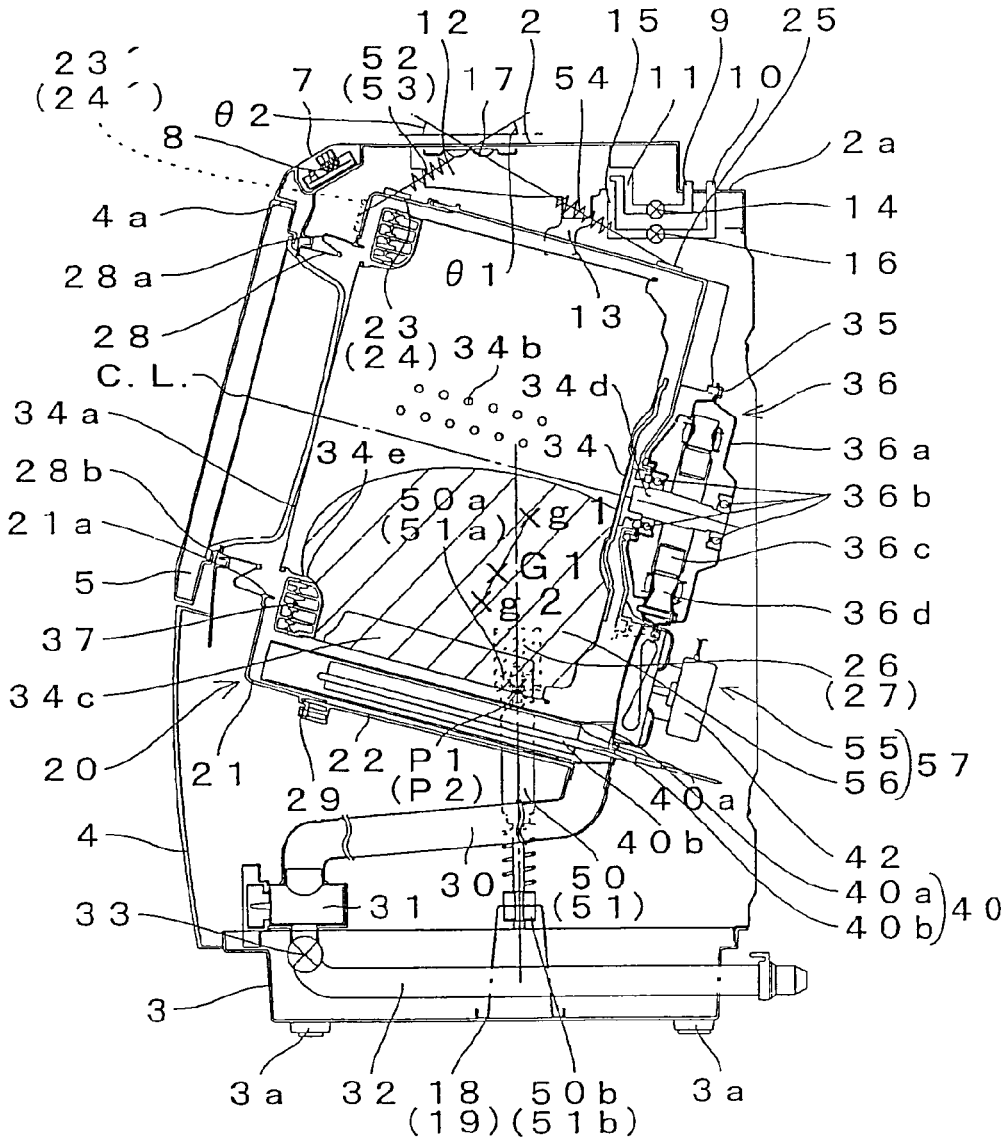
FIG. 2 A schematic vertical cross-sectional view of the drum-type washing machine of the first embodiment of the present invention, as seen from a side.
Figure 3:
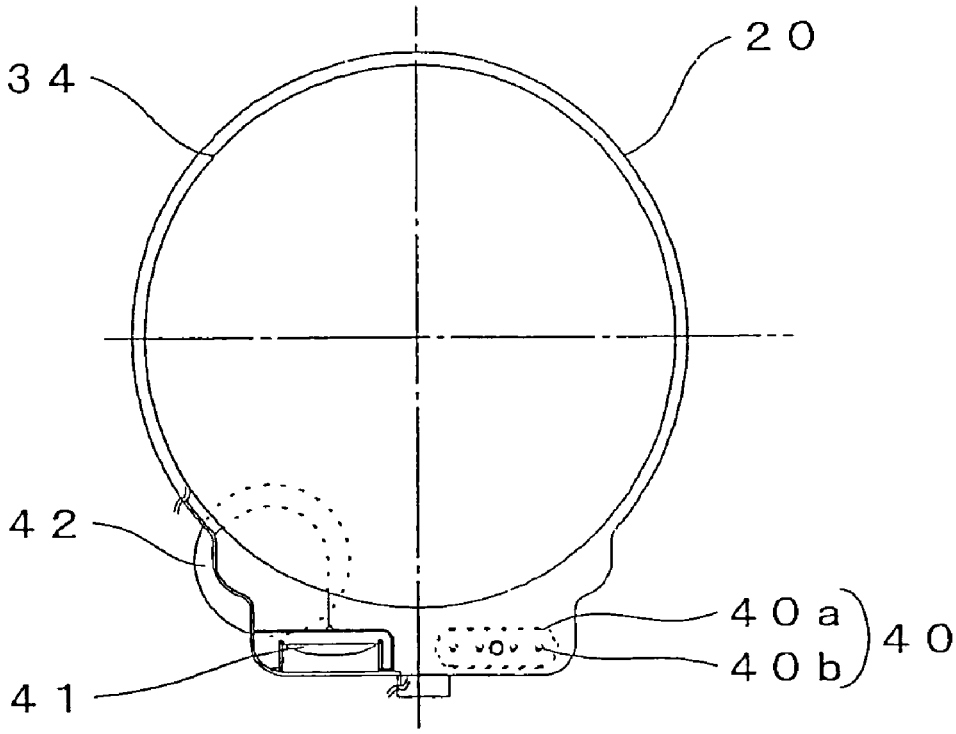
FIG. 3 A schematic vertical cross-sectional view of the drum-type washing machine of the first embodiment of the present invention, showing the water tub's interior structure as seen from in front.
Figure 4:
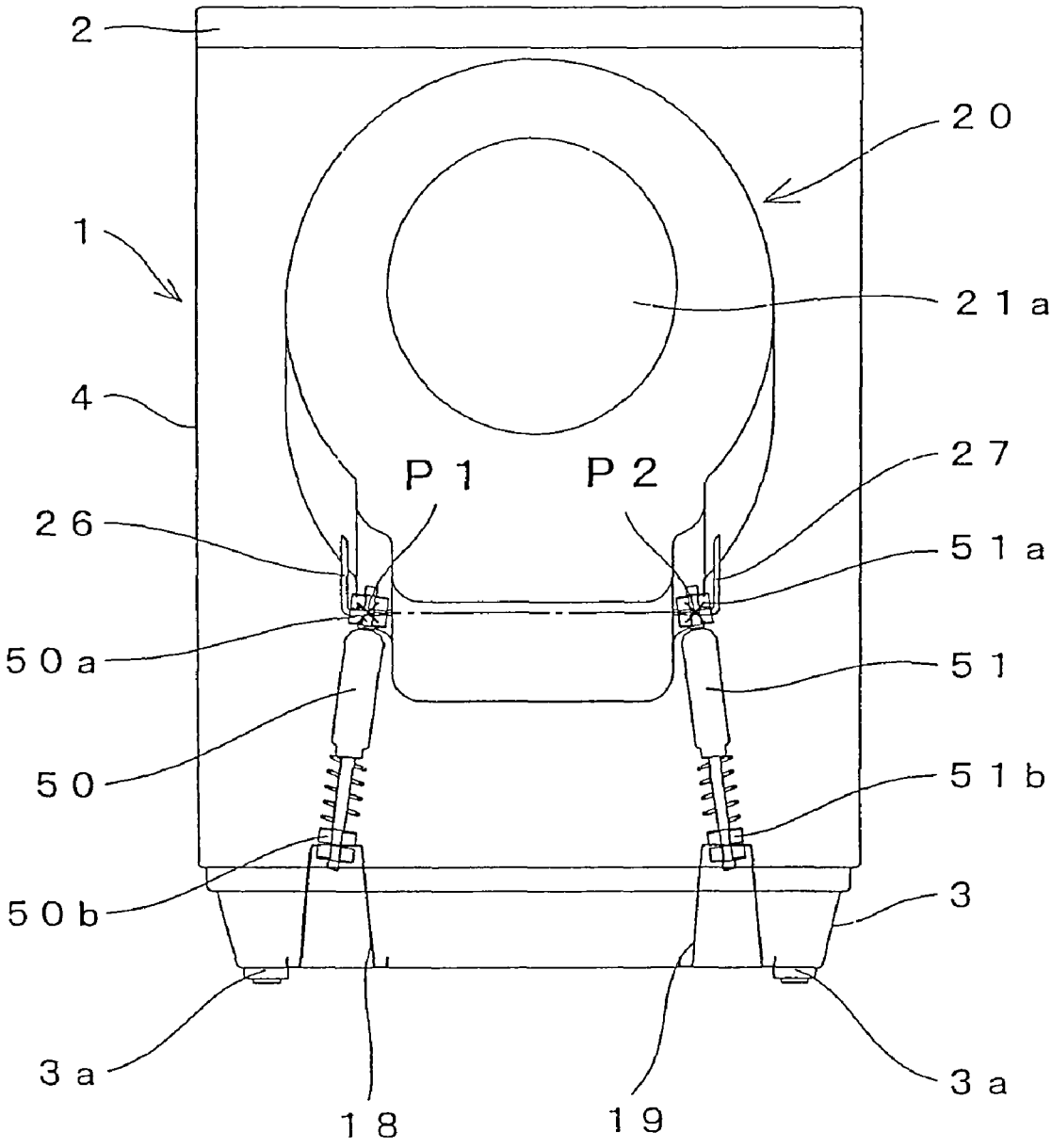
FIG. 4 A schematic vertical cross-sectional view of the drum-type washing machine of the first embodiment of the present invention, showing the water tub supporting structure as seen from the front.
Figure 5:
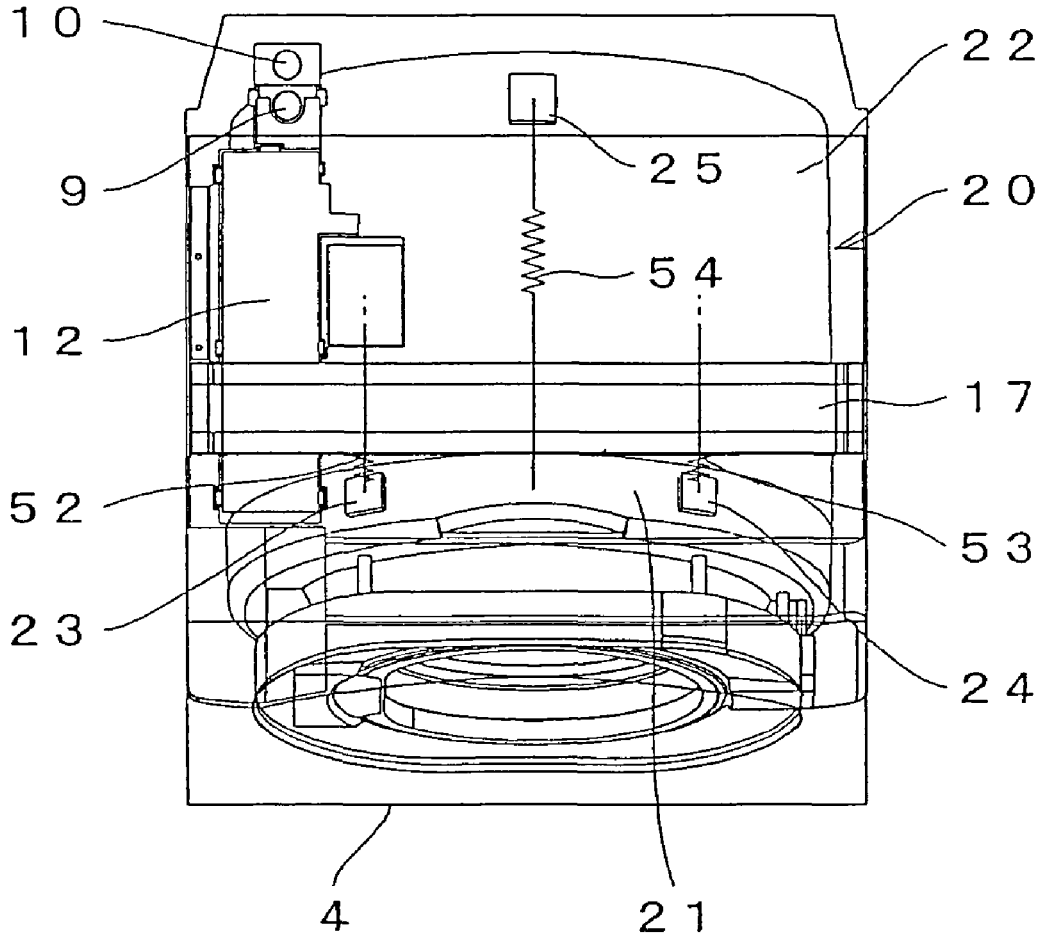
FIG. 5 A schematic horizontal cross-sectional view of the drum-type washing machine of the first embodiment of the present invention, as seen from above.

The drum-type washing machine of a first embodiment of the present invention will be described below with reference to FIGS. 1 to 5. FIG. 1 is a schematic diagram showing the exterior appearance of the drum-type washing machine of the first embodiment of the present invention, as seen from obliquely above. FIG. 2 is a schematic vertical cross-sectional view of the same drum-type washing machine, as seen from a side. FIG. 3 is a schematic vertical cross-sectional view showing the water tub's interior structure, as seen along the axis of the cylindrical shape thereof (i.e. in a direction parallel to C.L. shown in FIG. 2). FIG. 4 is a schematic vertical cross-sectional view showing the water tub supporting structure, as seen from in front. FIG. 5 is a schematic horizontal cross-sectional view of the same drum-type washing machine.

As shown in FIG. 1, the drum-type washing machine of the first embodiment of the present invention has a cabinet 1 that forms the exterior surface thereof. The cabinet 1 has, on the top face thereof, a top plate 2 and, on the bottom face thereof, a bottom stand 3. The cabinet 1 further has a body 4 covering the front, rear, left, and right side faces thereof. The top plate 2 has a rear part thereof one step lowered to form a depressed portion 2*a*, and, in this depressed portion 2*a*, there are arranged a tap water feed port 9 and a bath water feed port 10, which will be described later. As shown in FIG. 2, on the inner surface (facing the inside of the cabinet 1) of the top plate 2, in a middle part thereof in the front-rear direction of the drum-type washing machine, a suspension fitting portion 17 is provided. The suspension fitting portion 17 is a metal plate to which are coupled one ends of suspensions 52, 53, and 54, which will be described later.

The bottom stand 3 has a substantially rectangular shape in a horizontal cross-section thereof, and is so designed that the front, rear, left, and right side faces thereof are located one step inward of the corresponding faces of the body 4 placed on top thereof. Under the bottom surface of the bottom face of the bottom stand 3, near the corners of the substantially rectangular shape of the bottom stand 3, feet 3*a* are fitted that, when the drum-type washing machine is installed, make contact with the floor surface to support the drum-type washing machine. On the top surface of the bottom face of the bottom stand 3, as shown in FIG. 4, damper fitting portions 18 and 19 are arranged to which are coupled one ends of dampers 50 and 51, which will be described later. As shown in FIG. 4, the damper fitting portion 18 is arranged on the left, and the damper fitting portion 19 on the right. The damper fitting portions 18 and 19 are arranged to be located, as seen from a side, at the same position. In FIG. 2, along with the reference numeral of the damper fitting portion 18, the reference numeral of the damper fitting portion 19 is indicated in parentheses; this signifies that, as seen from the side from which the figure is drawn, the damper fitting portions 18 and 19 are fitted at the same position. Likewise, throughout the following description, any unparenthesized reference numeral indicated along with another in parentheses in a figure signifies that, as seen from the direction from which the figure is drawn, the components they indicate are located at the same position.

The body 4 has a substantially rectangular shape in a horizontal cross-section thereof. As shown in FIGS. 1 and 2, the front face of the body 4 is so designed as to incline rearward with respect to a vertical plane as one goes upward, in other words, to describe, as seen from a side, a circular arc. As shown in FIG. 1, on the front face of the body 4, there are arranged a cabinet opening 4*a* that is open between inside and outside the cabinet 1; a detergent case 6 that accommodates detergent, bleach, and softener; and an operation panel 7 including operation keys and a display portion.

The cabinet opening 4*a* is opened and closed with a door 5 that is pivotably fitted to the body 4 with a hinge (unillustrated). The detergent case 6 includes an unillustrated container provided inside the body 4, and is arranged, slidably in the front-rear direction, leftward above the cabinet opening 4*a* of the body 4. The operation panel 7 is arranged on the right of the detergent case 6, i.e. rightward above the cabinet opening 4*a* of the body 4, and accepts various settings and operation commands from the user.

As shown in FIG. 2, behind the operation panel 7, inside the drum-type washing machine, a control circuit 8 is arranged that controls the operation of the drum-type washing machine. The control circuit 8 controls the operation of different parts of the drum-type washing machine according to an operation program selected by the user from among those, such as "standard course", "wool course", and "drying course", previously stored in an unillustrated storage means so that a washing process, a rinsing process, and a spin-drying process (and a air-drying process) are performed sequentially or singly.

As shown in FIG. 2, in the depressed portion 2*a*, which is formed by lowering a rear part of the top plate 2, there are provided a tap water feed port 9 via which tap water distributed to a faucet (unillustrated) is supplied into the drum-type washing machine, and a bath water feed port 10 via which water from a bath tub is supplied into the drum-type washing machine. Tap water fed in via the tap water feed port 9 flows through a water feed pipe 11, then through the detergent case 6 and a water feed container 12 that incorporates it, then through a water feed duct 13 that connects the water feed container 12 to a water tub 20, which will be described later, then into the water tub 20. The water feed pipe 11 is fitted with a water feed valve 14, and, as a result of the water feed valve 14 being opened and closed under the control of the control circuit 8, the supply of tap water into the water tub 20 is controlled. The water feed duct 13 is formed of a flexible material, such as nylon or rubber, so as not to easily conduct the vibrations of the water tub 20 to the cabinet 1. On the other hand, bath water sucked in via the bath water feed port 10 flows through a bath water pipe 15, then through the detergent case 6 and the water feed container 12 that incorporates it, then through the water feed duct 13 that connects the water feed container 12 to the water tub 20, then into the water tub 20, which will be described later. The bath water pipe 15 is fitted with a bath water pump 16, and, as a result of the bath water pump 16 being driven and stopped under the control of the control circuit 8, the supply of bath water into the water tub 20 is controlled.

As shown in FIG. 2, inside the cabinet 1, a water tub 20 having the shape of a bottomed cylinder is arranged so that a rear part thereof is 5° to 30° inclined downward with respect to a horizontal plane. As shown in FIG. 3, the water tub 20 is so formed that, as seen along the axis of the cylindrical shape thereof (i.e. in a direction parallel to C.L. shown in FIG. 2), the circumferential wall of an upper part thereof is cylindrical while part of the circumferential wall of a lower part thereof protrudes outward. The water tub 20 is built by coupling together a front section 21, which forms a front part of the water tub 20 along the axis thereof, and a rear section 22, which forms a rear part of the water. tub 20 along the axis thereof, with screws 29. On the front section 21, in an upper part of the outer circumferential surface thereof, suspension fitting portions 23 and 24 are provided to which are coupled one ends of suspensions 52 and 53, which will be described later. As shown in FIG. 5, the suspension fitting portion 23 is arranged on the left, and the suspension fitting portion 24 on the right; the suspension fitting portions 23 and 24 are arranged to be located, as seen from a side, at the same position. As shown in FIG. 5, on the rear section 22, in an upper part of the outer circumferential surface thereof, in a rear-central part thereof, a suspension fitting portion 25 is provided to which is coupled one end of a suspension 54, which will be described later. Moreover, as shown in FIG. 4, on the rear section 22, in a lower part of the outer circumferential surface thereof, damper fitting portions 26 and 27 are arranged to which are coupled one ends of dampers 50 and 51, which will be described later. As shown in FIG. 4, the damper fitting portion 26 is arranged on the left, and the damper fitting portion 27 on the right; the damper fitting portions 26 and 27 are arranged to be located, as seen from a side, at the same position.

As shown in FIG. 2, in the front section 21, a water tub opening 21*a* is formed that open toward the cabinet opening 4*a*. The water tub opening 21*a* is fitted with a door gasket 28 that couples the water tub opening 21*a* to the cabinet opening 4*a* through a watertight passage. The door gasket 28 has a bellows portion 28*a* so as not to easily conduct the vibrations of the water tub 20 to the cabinet 1. With the door 5 closed, it makes watertight contact with a seal portion 28*b* of the door gasket 28 to prevent liquid inside the water tub 20 from leaking out through the cabinet opening 4*a*. In an upper central part of the water tub 20, the water feed duct 13 is connected to the water tub 20. Through the water feed duct 13, water fed in via the tap water feed port 9 and the bath water feed port 10 flows into the water tub 20.

On the other hand, as shown in FIG. 2, in a lower rear part of the water tub 20, where the height thereof from the floor surface is smallest, a water drain duct 30 is connected to the water tub 20. Through the water drain duct 30, liquid, such as water and washing fluid, inside the water tub 20 is drained out of it. The water drain duct 30 is connected via a filter unit 31, which removes lint from the liquid flowing out of the water tub 20, then via a water drain valve 33, to a water drain hose 32, which leads out of the drum-type washing machine. As a result of the water drain valve 33 being opened and closed under the control of the control circuit 8, the drainage of water out of the water tub 20 is controlled.

As shown in FIG. 2, inside the water tub 20, a drum 34 having the shape of a bottomed cylinder is arranged, like the water tub 20, in such a way that, as one goes rearward, the cylinder axis thereof (C.L. shown in FIG. 2) is 50 to 30° inclined downward with respect to a horizontal axis. Moreover, as shown in FIG. 3, the cylinder axis of the drum 34 is substantially concentric with the cylinder axis of the upper circumferential wall of the water tub 20. That is, the distance from the lower circumferential wall of the drum 34 to the outward protruding lower circumferential wall of the water tub 20 is larger than the distance from the upper circumferential wall of the drum 34 to the upper circumferential wall of the water tub 20. In the space between the lower circumferential wall of the drum 34 and the outward protruding lower circumferential wall of the water tub 20, a heater portion 40 is arranged, which will be described later. In the drum 34, a drum opening 34*a* is formed that is open toward the cabinet opening 4*a* and toward the water tub opening 21*a*. Thus, through the cabinet opening 4*a*, the water tub opening 21*a*, and the drum opening 34*a*, laundry is put into and taken out of the drum 34.

The drum 34 has a large number of small holes 34*b* formed all over the cylindrical circumferential surface thereof (in FIG. 2, only twelve of the small holes 34*b* are illustrated, with the others omitted from illustration). The small holes 34*b* are open between inside the water tub 20 and inside the drum 34, allowing air and liquid to pass between inside the water tub 20 and inside the drum 34. On the inner wall surface of the drum 34, baffles 34*c* are provided that protrude toward the cylinder center axis of the drum 34. The baffles 34*c* are arranged in n-fold rotation symmetry (where n is a natural number equal to or greater than 2) around the circumference; for example, three of them are arranged at 120° intervals (in 3-fold rotation symmetry) around the circumference. In a washing or rinsing process, as the drum 34 rotates with laundry placed inside it, the baffles 34*c* repeatedly lift the laundry out of washing or rinsing water and then drop it back into it to achieve the washing or rinsing of the laundry.

In a central part of the rear surface of the drum 34, a drum shaft 34*d* is provided to protrude rearward therefrom coaxially with the cylinder axis of the drum 34. The drum shaft 34*d* penetrates the bottom surface of the rear section 22 of the water tub 20, and the tip end of the drum shaft 34*d* fits into a motor 36 that is fitted on the rear surface of the rear section 22 with screws 35. The motor 36 includes a motor cover 36*a*, a bearing 36*b*, a rotor 36*c*, and a stator 36*d*. The motor cover 36*a* encloses the motor 36. The bearing 36*b* rotatably supports the drum shaft 34*d*. The rotor 36*c* drives the drum shaft 34*d* to rotate. The stator 36*d* magnetically gives the rotor 36*c* a rotating drive force. Thus, as a result of the motor 36 driving the rotor 36*c* via the stator 36*d* under the control of the control circuit 8, the drum 34 is driven to rotate.

Around the drum opening 34*a*, the circumferential surface of the drum 34 is narrowed by being bent inward in the radial direction to form a narrowed portion 34*e*, around which a liquid balancer 37 is fixed. The liquid balancer 37 includes a hollow ring-shaped outer shell and a liquid, such as a salt water, sealed therein. The liquid balancer 37, with the movement of the liquid inside it, cancels unbalance resulting from uneven weight distribution in laundry, especially during high-speed rotation in a spin-drying process.

As shown in FIGS. 2 and 3, in a right-hand part of the space between a lower part of the inner circumferential surface of the water tub 20 and a lower part of the outer circumferential surface of the drum 34, a heater portion 40 is provided. The heater portion 40 includes a heater case 40*a* that forms an air passage and a heater 40*b* arranged inside the heater case 40*a*. In a washing process or rinsing process, the heater 40*b* heats washing or rinsing water to expedite washing or rinsing; in an air-drying process, the heater 40*b* heats the air inside the water tub. As shown in FIG. 3, in a left-hand part of the space between a lower part of the inner circumferential surface of the water tub 20 and a lower part of the outer circumferential surface of the drum 34, a heat exchange plate 41 for dehumidification is provided. The heat exchange plate 41 has an open cross-sectional shape; in an air-drying process, when water fed in via the tap water feed port 9 is passed across the top surface of the heat exchange plate 41, the heat exchange plate 41 cools the air inside the water tub 20. At a lower part of the rear surface of the water tub 20, a blowing fan 42 is fitted. The blowing fan 42 sucks in air that has passed through the heat exchange plate 41, and then discharges the air to the heater portion 40.

Specifically, in the drum-type washing machine of the first embodiment, in an air-drying process, air heated by the heater portion 40 flows into the drum 34 to evaporate moisture contained in laundry. The resulting wet air, containing much evaporated moisture, is cooled by the heat exchange plate 41, and is thereby dried, with the moisture condensed. The dry air is sent by the blowing fan 42 to the heater portion 40, by which the air is heated again to be used to remove moisture from laundry. This sequence is repeated until the air-drying of the laundry is completed, and, in this way, an air-drying process proceeds. Since the heater portion 40, the heat exchange plate 41, and the blowing fan 42 are provided in a lower part of the water tub, in a washing or rinsing process, those components submerge in washing or rinsing water; this makes it possible to remove lint settled on those components.

Outside the water tub 20, under it, two dampers 50 and 51 are arranged that serve as a damping device for elastically supporting, by pressing upward, the water tub 20 from below. As shown in FIG. 4, as seen from in front, the damper 50 supports a left side part of the water tub 20, and the damper 51 supports a right side part of the water tub 20. In the first embodiment, used as the dampers 50 and 51 are common oil dampers that are each composed of, as an upper part thereof, a cylinder portion having oil sealed therein and, as a lower part thereof, a coil spring so as to offer elasticity and to exert a damping effect. Instead, any other type of dampers, such as air dampers, may be adopted that offer similar performance. One ends of the dampers 50 and 51 are respectively coupled, via elastic members 50*a* and 51*a*, to the damper fitting portions 26 and 27 provided on the outer circumferential surface of the water tub 20. The other ends of the dampers 50 and 51 are coupled, via elastic members 50*b* and 51*b*, to the damper fitting portions 18 and 19 provided on the bottom face of the bottom stand 3. Thus, the dampers 50 and 51 elastically support, by pressing upward, the water tub 20. The coupling between the dampers 50 and 51 and the water tub 20 and between the dampers 50 and 51 and the cabinet 1 is achieved via the elastic members 50*a*, 51*a*, 50*b*, and 51*b*. This contributes to reduced propagation of vibrations from the water tub 20 to the cabinet 1 and further to the floor.

As shown in FIG. 4, as seen from in front, the damper fitting portion 18 is arranged on the left of the damper fitting portion 26, and the damper fitting portion 19 is arranged on the right of the damper fitting portion 27; that is, as seen from in front, the dampers 50 and 51 are so fitted as to be increasingly close to each other upward. As seen from a side, the damper fitting portions 18 and 19 are arranged at the same position in the front/rear and up/down directions, and, likewise, the damper fitting portions 26 and 27 are arranged at the same position in the front/rear and up/down directions; the damper fitting portions 18 and 19 are respectively arranged vertically below the damper fitting portions 26 and 27. Thus, the axis P1-P2 (see FIG. 4) passing through the connecting position P1 (see FIGS. 2 and 4) between the damper fitting portion 26 and the damper 50 and the connecting position P2 (see FIG. 4) between the damper fitting portion 27 and the damper 51 is parallel to a horizontal axis that runs in the left/right direction of the drum-type washing machine. Moreover, the dampers 50 and 51 are so arranged that the directions in which they elastically support lie on the same vertical plane.

Outside the water tub 20, above it, three suspensions 52, 53, and 54 are arranged that serve as a suspending device for elastically supporting, by suspending downward, the water tub 20 from above. As shown in FIG. 5, as seen from above, the suspension 52 supports a front left side part of the water tub 20, the suspension 53 supports a front right side part of the water tub 20, and the suspension 54 supports a rear central part of the water tub 20. One ends of the suspensions 52, 53, and 54 are respectively coupled to a left side part, a right side part, and a central part of the suspension fitting portion 17. The other ends of the suspensions 52, 53, and 54 are respectively coupled to the suspension fitting portions 23, 24, and 25 provided on the outer circumference surface of the water tub 20. In the first embodiment, used as the suspensions 52, 53, and 54 are common coil springs. Instead, any other type of members, such as air dampers, may be adopted that can elastically support by suspension. Thus, the suspensions 52, 53, and 54 elastically support, by suspending downward, the water tub 20. This contributes to reduced propagation of vibrations from the water tub 20 to the cabinet 1 and further to the floor.

As shown in FIG. 2, the suspension fitting portion 17 is arranged behind and above the suspension fitting portion 23 (24), and in front of and above the suspension fitting portion 25. That is, as shown in FIG. 2, the suspension 52 (53) is so arranged that the direction in which the suspension 52 (53) supports, i.e. the direction running from where it is fitted to the water tub 20 toward the suspension fitting portion 17, forms an angle of $\theta 1 (0° < \theta 1 < 90°)$ with respect to a horizontal axis running in the front/rear direction. On the other hand, the suspension 54 is so arranged that the direction in which the suspension 54 supports, i.e. the direction running from where it is fitted to the water tub 20 toward the suspension fitting portion 17, forms an angle of $\theta 2$ $(0° < \theta 2 < 90°)$ with respect to a horizontal axis running in the front/rear direction. That is, as seen from a side, the suspensions 52 (53) and 54 are so fitted as to be increasingly close to each other upward. Moreover, as shown in FIG. 2, the suspension fitting portion 17 is arranged in front of the center of gravity G1 of the vibrating body load 57, which will be described later, as present when laundry has the rated weight. This allows the suspension 52 (53) to more effectively lift the front part of the water tub 20. Moreover, as shown in FIG. 5, as seen from above, the suspensions 52, 53, and 54 are arranged parallel to the front/rear direction of the drum-type washing machine.

In this drum-type washing machine, the following components are elastically supported along with the water tub 20 (including the damper fitting portions 26 and 27 and the suspension fitting portions 23, 24, and 25) inside the cabinet 1 by the dampers 50 and 51 and the suspensions 52, 53, and 54: the drum 34 (including the baffles 34*c* and the drum shaft 34*d*), the motor 36, the heater portion 40, the heat exchange plate 41, the blowing fan 42, and the liquid balancer 37. In the following description, the body of mass constituted by those components (the water tub 20, the drum 34, the motor 36, the heater portion 40, the heat exchange plate 41, the blowing fan 42, and the liquid balancer 37), which vibrate along with the water tub 20 in a washing or air-drying process, will be referred to as the structural load 55. In a washing or rinsing process, the laundry placed inside the drum 34 and the washing or rinsing water fed into the water tub 20 add to the load on the dampers 50 and 51 and the suspensions 52, 53, and 54 so as also to be elastically supported, along with the water tub 20, by the dampers 50 and 51 and the suspensions 52, 53, and 54. The body of mass constituted by the laundry and the washing or rinsing water acting as an additional load on the dampers 50 and 51 and the suspensions 52, 53, and 54 in a washing or rinsing process will be referred to as the laundering load 56. The body of mass constituted by the structural load 55 and the laundering load 56 considered together will be referred to as the vibrating body load 57.

In FIG. 2, the center of gravity of the structural load 55 is indicated by g1, the center of gravity of the laundering load 56 as present when laundry having the rated weight is put in is indicated by g2, and the center of gravity of the vibrating body load 57 is indicated by G1. In the first embodiment of the present invention, the center of gravity g2 of the laundering load 56 is located in front of and below the center of gravity g1 of the structural load 55. The center of gravity G1 of the vibrating body load 57 is located on the line connecting between the center of gravity g2 of the laundering load 56 and the center of gravity g1 of the structural load 55. Here, as shown in FIG. 2, the dampers 50 and 51 are so arranged as to support between the center of gravity g1 of the structural load 55 and the center of gravity G1 of the vibrating body load 57. Specifically, this means that there is an intersection between the vertical plane on which the axes of direction in which the dampers 50 and 51 respectively elastically support both lie and the line connecting between the center of gravity g1 of the structural load 55 and the center of gravity g2 of the laundering load 56.

In a laundering process, such as a washing process, rinsing process, or spin-drying process, or in an air-drying process, the posture of the water tub 20 is influenced by the position of the center of gravity of the vibrating body load 57 in the front/rear direction with respect to the axis P1-P2 passing through the connecting position P1 between the damper fitting portion 26 and the damper 50 and the connecting position P2 between the damper fitting portion 27 and the damper 51. Specifically, if the center of gravity of the vibrating body load 57 lies in front of the axis P1-P2, the front part of the water tub 20 located in front of the axis P1-P2 tends to be displaced downward, and the rear part of the water tub 20 located behind the axis P1-P2 tends to be displaced upward. That is, in the vertical cross-sectional view of FIG. 2 as seen from the right side, the vibrating body load 57 develops a counter-clockwise momentum about the axis P1-P2, and thus the water tub 20 rotates counter-clockwise about the axis P1-P2.

In contrast, if the center of gravity of the vibrating body load 57 lies behind the axis P1-P2, the front part of the water tub 20 located in front of the axis P1-P2 tends to be displaced upward, and the rear part of the water tub 20 located behind the axis P1-P2 tends to be displaced downward. That is, in the vertical cross-sectional view of FIG. 2 as seen from the right side, the vibrating body load 57 develops a clockwise momentum about the axis P1-P2, and thus the water tub 20 rotates clockwise about the axis P1-P2. In addition to this rotational displacement, the weight of the laundering load 56 as present when laundry having the rated weight is put in acts to make the dampers 50 and 51 contract, causing the water tub 20 as a whole to be displaced further downward.

In the drum-type washing machine of the first embodiment, the center of gravity of the laundering load 56 is located below and in front of the center of gravity g1 of the structural load 55. Thus, as the weight of the laundering load 56 increases, the center of gravity of the vibrating body load 57 shifts frontward, and thus the sinking displacement of the front part of the water tub 20 increases. As described previously, the suspensions 52 and 53 pull the front part of the water tub 20 upward-rearward; that is, they exert a tensile force that makes the water tub 20 rotate clockwise, in FIG. 2, about the axis P1-P2. On the other hand, the suspension 54 pulls the rear part of the water tub 20 upward-frontward; that is, it exerts a tensile force that makes the water tub 20 rotate counter-clockwise, in FIG. 2, about the axis P1-P2. In this way, the rotation of the water tub 20 about the axis P1-P2 can be effectively prevented. Moreover, by pulling upward, the suspensions 52, 53, and 54 prevent the front and rear parts of the water tub 20 from sinking. Preventing the sinking of, in particular, the front part of the water tub 20, as tends to be inconveniently experienced, helps prevent the door gasket 28 from being damaged from overdeformation. Moreover, there is no need to provide portions for fitting the suspensions 52 and 53 in a front upper part of the body 4 of the cabinet 1, and thus there are no restrictions on the shape of the front upper part of the body 4 of the cabinet 1.

In general, a drum-type washing machine is not operated with the weight of the laundering load 56 zero, and is rarely operated with laundry having the rated weight put in. In a spin-drying process, in which vibrations are particularly likely to occur, even if laundry having the rated weight is put in, the drum 34 rotates in a state in which the liquid inside the water tub 20 has been drained (except the water absorbed in the laundry). Thus, in a spin-drying process, the center of gravity of the vibrating body load 57 is located, in the front/rear direction, between the center of gravity g1 of the structural load 55 and the center of gravity G1 of the vibrating body load 57. Thus, arranging the dampers 50 and 51 so that they support between the center of gravity g1 of the structural load 55 and the center of gravity G1 of the vibrating body load 57 as in the first embodiment makes it possible to realize a drum-type washing machine that can maintain the desired position of the water tub 20 regardless of the amount of laundry placed inside the drum 34.

Second Embodiment of the Present Invention

Figure 6:
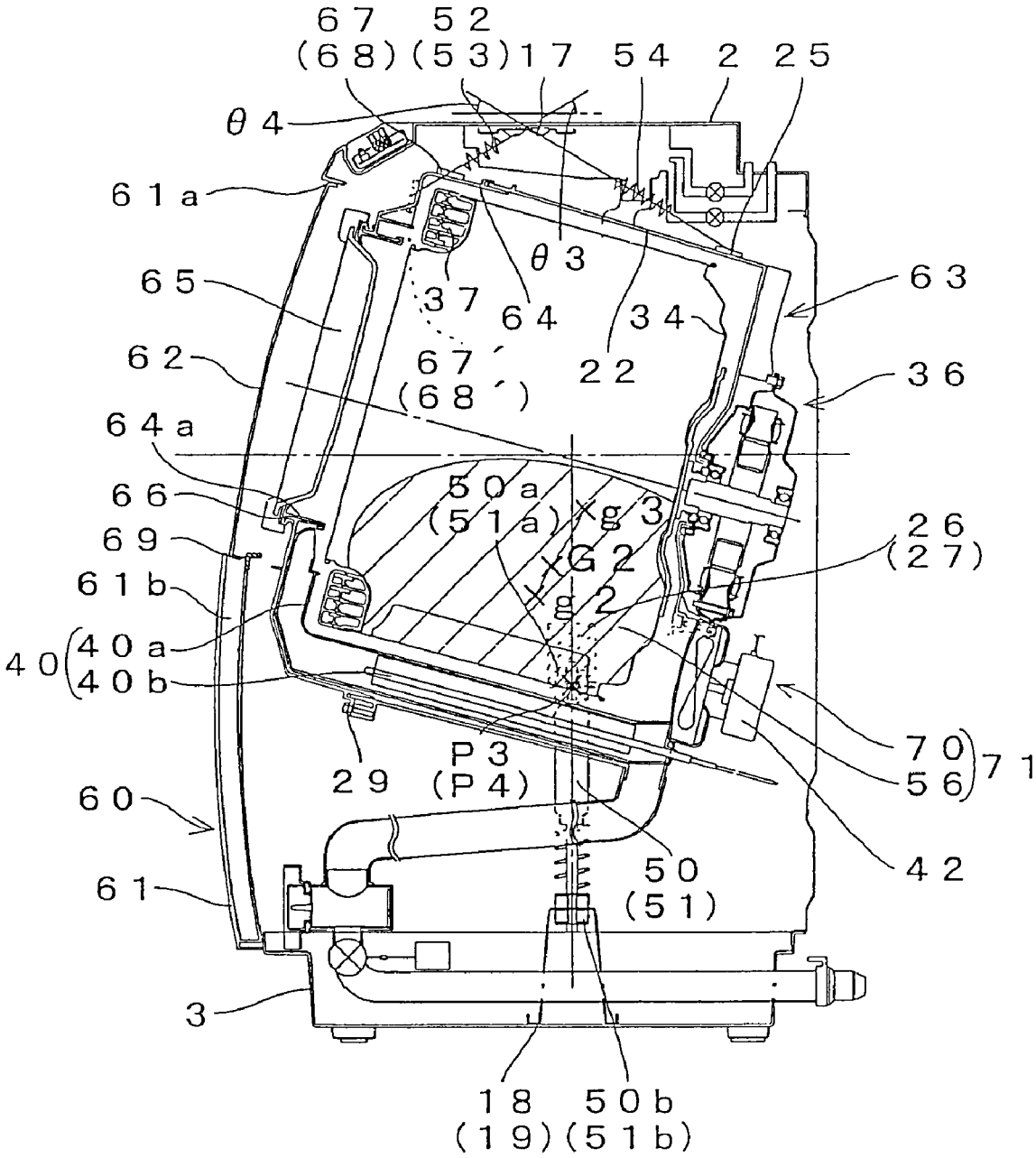
FIG. 6 A schematic vertical cross-sectional view of the drum-type washing machine of a second embodiment of the present invention, as seen from a side.

Next, the drum-type washing machine of a second embodiment of the present invention will be described with reference to FIG. 6. FIG. 6 is a schematic vertical cross-sectional view of the drum-type washing machine of the second embodiment of the present invention, as seen from a side. In the following description of the second embodiment, such parts as are found also in the first embodiment described above are identified by common reference numerals, and no overlapping description will be repeated; that is, the second embodiment will be described in terms of its features different from the first embodiment.

As shown in FIG. 6, the drum-type washing machine of the second embodiment of the present invention has a cabinet 60 that forms the exterior surface thereof. The cabinet 60 has, on the top face thereof, a top plate 2 and, on the bottom face thereof, a bottom stand 3. The cabinet 60 further has a body 61 covering the front, rear, left, and right side faces thereof. In the front face of the body 61, a cabinet opening 61*a* is formed that is open between inside and outside the cabinet 60, and, as in the first embodiment, above the cabinet opening 61*a*, there are provided a detergent case and an operation panel, both unillustrated. The cabinet opening 61*a* is opened and closed with a door 62 that is fitted to the body 61 so as to be slidable in the up/down direction along slide grooves 61*b*. At the lower end of the cabinet opening 61*a*, a soft material member 69 is fitted that is formed of a material, such as elastomer, that is soft and elastic. The soft material member 69 serves to prevent unusual noise, and also damage to and scratches on components, resulting from a water tub 63 and the cabinet 60 making contact with each other when a front part of the water tub 63 greatly sinks.

Inside the cabinet 60, a water tub 63 having the shape of a bottomed cylinder is arranged so that a rear part thereof is 5° to 30° inclined downward with respect to a horizontal plane. The water tub 63 is built by coupling together a front section 64, which forms a front part of the water tub 63 along the axis thereof, and a rear section 22, which forms a rear part of the water tub 63 along the axis thereof, with screws 29. In the front section 64, a water tub opening 64*a* is formed that is open toward the cabinet opening 61*a*. The water tub opening 64*a* is opened and closed with a water tub door 65 that is pivotably fitted with a hinge (unillustrated). The water tub opening 64*a* is fitted with a sealing member 66 that covers the inner circumferential surface thereof and a part around it of the front face of the front section 64. Thus, when the water tub door 65 is shut, the water tub door 65 and the sealing member 66 make watertight contact with each other to prevent liquid inside the water tub 63 from leaking through the cabinet opening 61*a*.

On the front section 64, in an upper part of the outer circumferential surface thereof, suspension fitting portions 67 and 68 are provided to which are coupled one ends of suspensions 52 and 53. As in the first embodiment, the suspension fitting portions 67 and 68 are so arranged that the suspension fitting portion 67 is arranged on the left and the suspension fitting portion 24 on the right, and that the suspension fitting portions 67 and 68 are located, as seen from a side, at the same position.

With the water tub 63 fitted to the cabinet 60, as in the first embodiment, the damper fitting portion 18 is arranged on the left of the damper fitting portion 26, and the damper fitting portion 19 is arranged on the right of the damper fitting portion 27; that is, as seen from in front, the dampers 50 and 51 are so fitted as to be increasingly close to each other upward. As seen from a side, the damper fitting portions 18 and 19 are arranged at the same position in the front/rear and up/down directions, and, likewise, the damper fitting portions 26 and 27 are arranged at the same position in the front/rear and up/down directions; the damper fitting portions 18 and 19 are respectively arranged vertically below the damper fitting portions 26 and 27. Thus, the axis P3-P4 (see FIG. 4) passing through the connecting position P3 (corresponding to P1 in FIG. 4) between the damper fitting portion 26 and the damper 50 and the connecting position P4 (corresponding to P2 in FIG. 4) between the damper fitting portion 27 and the damper 51 is parallel to a horizontal axis that runs in the left/right direction of the drum-type washing machine. The dampers 50 and 51 are so arranged that the directions in which they elastically support lie on the same vertical plane.

The suspension fitting portion 17, which is arranged in a central part, in the front/rear direction of the drum-type washing machine, of the bottom surface (facing the inside of the cabinet 60) of the top plate 2, is arranged, as in the first embodiment, so as to be located behind and above the suspension fitting portion 67 (68). Moreover, the suspension fitting portion 17 is arranged in front of and above the suspension fitting portion 25. That is, as shown in FIG. 6, the suspension 52 (53) is so arranged that the direction in which the suspension 52 (53) supports, i.e. the direction running from where it is fitted to the water tub 63 toward the suspension fitting portion 17, forms an angle of $\theta 3(0° < \theta 03 < 90°)$ with respect to a horizontal axis running in the front/rear direction. On the other hand, the suspension 54 is so arranged that the direction in which the suspension 54 supports, i.e. the direction running from where it is fitted to the water tub 63 toward the suspension fitting portion 17, forms an angle of $\theta 4(0° < \theta 4 < 90°)$ with respect to a horizontal axis running in the front/rear direction. That is, as seen from a side, the suspensions 52 (53) and 54 are so fitted as to be increasingly close to each other upward. Moreover, as shown in FIG. 6, the suspension fitting portion 17 is arranged in front of the center of gravity G2 of the vibrating body load 71, which will be described later, as present when laundry has the rated weight.

This allows the suspension 52 (53) to more effectively lift the front part of the water tub 63. Moreover, as in the first embodiment, as seen from above, the suspensions 52, 53, and 54 are arranged parallel to the front/rear direction of the drum-type washing machine.

In this drum-type washing machine, the structural load 70 is constituted by the water tub 63, the drum 34, the motor 36, the heater portion 40, the heat exchange plate (unillustrated in this embodiment, but arranged on the left of the heater portion 40 as in FIG. 3 of the first embodiment), the blowing fan 42, and the liquid balancer 37. Let g3 represent the center of gravity of the structural load 70, let g2 represent the center of gravity of the laundering load 56 as present when laundry having the rated weighted is put in, and let G2 represent the center of gravity of the vibrating body load 71 constituted by the structural load 70 and the laundering load 56 considered together. Then, as shown in FIG. 6, the dampers 50 and 51 are so arranged as to support between the center of gravity g3 of the structural load 70 and the center of gravity G2 of the vibrating body load 71.

If the center of gravity of the vibrating body load 71 lies in front of the axis P3-P4, the front part of the water tub 63 located in front of the axis P3-P4 tends to be displaced downward, and the rear part of the water tub 63 located behind the axis P3-P4 tends to be displaced upward. That is, in the vertical cross-sectional view of FIG. 6 as seen from the right side, the vibrating body load 71 develops a counter-clockwise momentum about the axis P3-P4, and thus the water tub 63 rotates counter-clockwise about the axis P3-P4. In contrast, if the center of gravity of the vibrating body load 71 lies behind the axis P3-P4, the front part of the water tub 63 located in front of the axis P3-P4 tends to be displaced upward, and the rear part of the water tub 63 located behind the axis P3-P4 tends to be displaced downward. That is, in the vertical cross-sectional view of FIG. 6 as seen from the right side, the vibrating body load 71 develops a clockwise momentum about the axis P3-P4, and thus the water tub 63 rotates clockwise about the axis P3-P4. In addition to this rotational displacement, the weight of the laundering load 56 as present when laundry having the rated weight is put in acts to make the dampers 50 and 51 contract, causing the water tub 63 as a whole to be displaced further downward.

In the first embodiment, the bellows portion 28*a* of the door gasket 28 damps and reduces the vibrations that conduct from the water tub 20 to the cabinet 1. Since this bellows portion 28*a* is slightly rigid, however, the vibrations of the water tub 20 still do conduct via the door gasket 28 to the cabinet 1. To improve this, in the drum-type washing machine of the second embodiment, no member is provided that directly couples the cabinet opening 61*a* and the water tub opening 64*a* together, and this helps make the vibrations of the water tub 20 less likely to conduct to the cabinet 1. In other words, in the first embodiment, the water tub opening 21*a* is suspended from the cabinet opening 4*a* by the slightly rigid bellows portion 28*a*. That is, in the drum-type washing machine of the second embodiment, the water tub opening 64*a* floats upward and sinks downward more than in the first embodiment. In the drum-type washing machine of this type, if the upward floating or downward sinking of the water tub opening 64*a* produces a large displacement, many inconveniences may arise: the water tub may interfere with the cabinet; the dampers and elastic member may receive overload; the water tub door 65, which watertightly closes the water tub opening 64*a*, may become unopenable, for example, as a result of the water tub door 65 deviating from the cabinet opening 61*a*, making midway addition of laundry impossible or making the door unopenable when laundry is to be taken out at the end of laundering, thus leading to greatly spoilt usability.

In the drum-type washing machine of the second embodiment, as in the first embodiment, the center of gravity of the laundering load 56 is located below and in front of the center of gravity g3 of the structural load 70. Thus, as the weight of the laundering load 56 increases, the center of gravity of the vibrating body load 71 shifts frontward, and thus the sinking displacement of the front part of the water tub 63 increases. The suspensions 52 and 53 pull the front part of the water tub 63 upward-rearward; that is, they exert a tensile force that makes the water tub 63 rotate clockwise about the axis P3-P4 passing through the connecting position P3 between the damper fitting portion 26 and the damper 50 and the connecting position P4 between the damper fitting portion 27 and the damper 51. On the other hand, the suspension 54 pulls the rear part of the water tub 63 upward-frontward; that is, it exerts a tensile force that makes the water tub 63 rotate counter-clockwise about the axis P3-P4. In this way, the rotation of the water tub 63 about the axis P3-P4 can be effectively prevented. Moreover, by pulling upward, the suspensions 52, 53, and 54 prevent the front and rear parts of the water tub 63 from sinking. That is, with the drum-type washing machine of the second embodiment, it is possible, without spoiling the effect of preventing the propagation of vibrations from the water tub 63 to the cabinet 60, to realize a drum-type washing machine that offers enhanced usability in that the water tub door 65 can surely be opened.

Third Embodiment of the Present Invention

Figure 7:
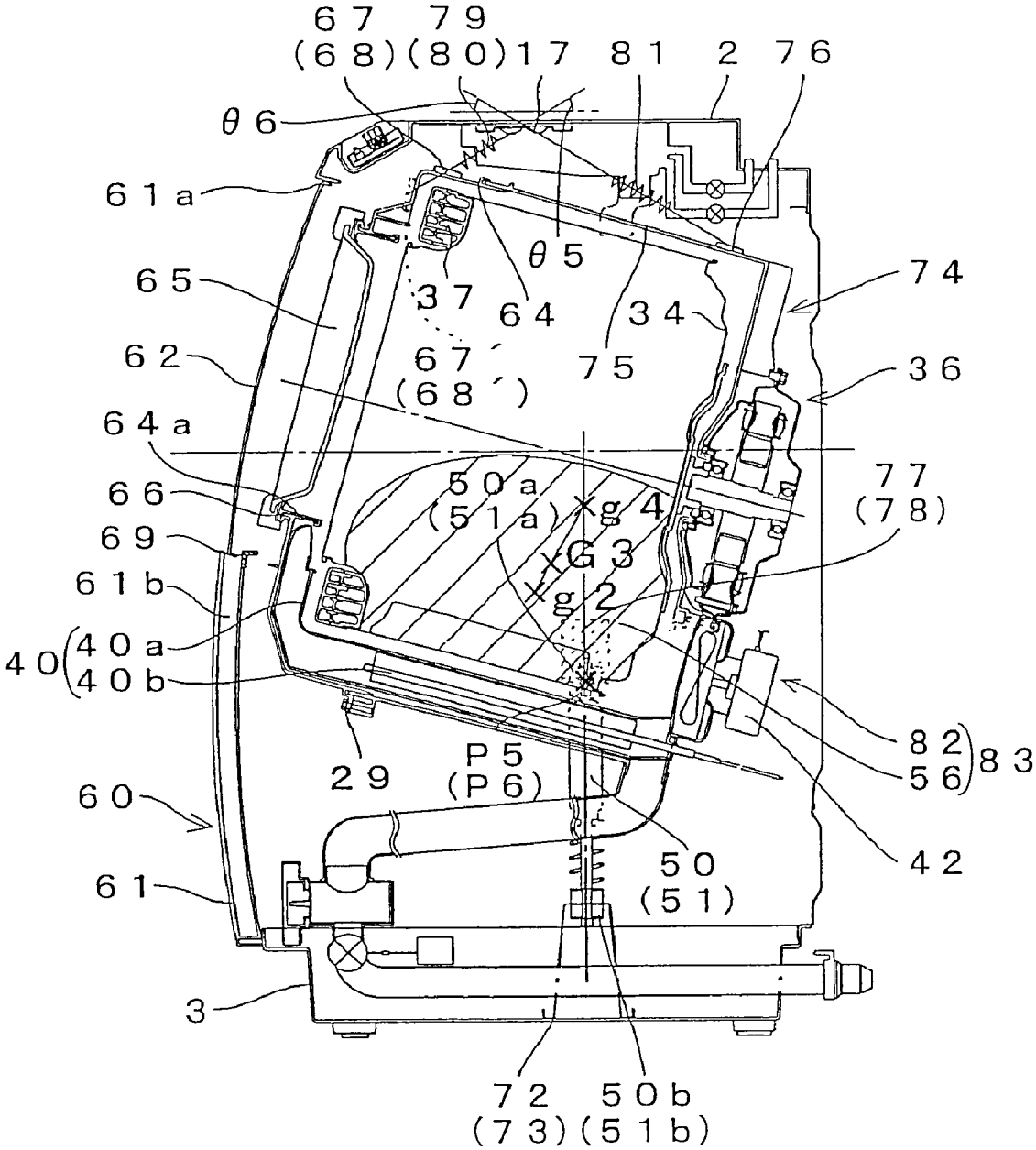
FIG. 7 A schematic vertical cross-sectional view of the drum-type washing machine of a third embodiment of the present invention, as seen from a side.

Next, the drum-type washing machine of a third embodiment of the present invention will be described with reference to FIG. 7. FIG. 7 is a schematic vertical cross-sectional view of the drum-type washing machine of the third embodiment of the present invention, as seen from a side. In the following description of the third embodiment, such parts as are found also in the second embodiment described above are identified by common reference numerals, and no overlapping description will be repeated; that is, the third embodiment will be described in terms of its features different from the second embodiment.

As shown in FIG. 7, the drum-type washing machine of the third embodiment of the present invention has a cabinet 60 that forms the exterior surface thereof. A lower part of the cabinet 60 is formed by a bottom stand 3, and, as shown in FIG. 7, on the bottom stand 3, on the upper surface of the bottom face thereof, damper fitting portions 72 and 73 are provided to which are coupled one ends of dampers 50 and 51, which will be described later. The damper fitting portion 72 is arranged on the left, and the damper fitting portion 73 is arranged on the right; as in the first embodiment, the damper fitting portions 72 and 73 are arranged to be located, as seen from a side, at the same position.

Inside the cabinet 60, a water tub 74 having the shape of a bottomed cylinder is arranged so that a rear part thereof is 5° to 30° inclined downward with respect to a horizontal plane. The water tub 74 is built by coupling together a front section 64, which forms a front part of the water tub 74 along the axis thereof, and a rear section 75, which forms a rear part of the water tub 74 along the axis thereof, with screws 29. As in the first embodiment, on the rear section 75, in an upper part of the outer circumferential surface thereof, in a rear-central part thereof, a suspension fitting portion 76 is provided to which is coupled one end of a suspension 81, which will be described later. Moreover, as in the first embodiment, on the rear section 75, in a lower part of the outer circumferential surface thereof, damper fitting portions 77 and 78 are provided to which are coupled one ends of dampers 50 and 51. The damper fitting portion 77 is arranged on the left, and the damper fitting portion 78 is arranged on the right; as in the first embodiment, the damper fitting portions 77 and 78 are arranged to be located, as seen from a side, at the same position.

One ends of the dampers 50 and 51 are respectively coupled, via elastic members 50*a* and 51*a*, to the damper fitting portions 77 and 78 provided on the outer circumferential surface of the water tub 74. The other ends of the dampers 50 and 51 are respectively coupled, via elastic members 50*b* and 51*b*, to the damper fitting portions 72 and 73 provided on the bottom face of the bottom stand 3. Thus, the dampers 50 and 51 elastically support, by pressing upward, the water tub 74. The coupling between the dampers 50 and 51 and the water tub 74 and between the dampers 50 and 51 and the cabinet 60 is achieved via the elastic members 50*a*, 51*a*, 50*b*, and 51*b*. This contributes to reduced propagation of vibrations from the water tub 74 to the cabinet 60 and further to the floor.

The damper fitting portion 72 is arranged on the left of the damper fitting portion 77, and the damper fitting portion 73 is arranged on the right of the damper fitting portion 78; that is, as seen from in front, the dampers 50 and 51 are so fitted as to be increasingly close to each other upward. As seen from a side, the damper fitting portions 72 and 73 are arranged at the same position in the front/rear and up/down directions; the damper fitting portions 77 and 78 are arranged at the same position in the front/rear and up/down directions; the damper fitting portions 72 and 73 are respectively arranged vertically below the damper fitting portions 77 and 78. Thus, the axis P5-P6 (see FIG. 4) passing through the connecting position P5 (corresponding to P1 shown in FIG. 4) between the damper fitting portion 77 and the damper 50 and the connecting position P6 (corresponding to P2 shown in FIG. 4) between the damper fitting portion 78 and the damper 51 is parallel to a horizontal axis that runs in the left/right direction of the drum-type washing machine. Moreover, the dampers 50 and 51 are so arranged that the directions in which they elastically support lie on the same vertical plane.

Outside the water tub 74, above it, three suspensions 79, 80, and 81 are arranged that serve as a suspending device for elastically supporting, by suspending downward, the water tub 74 from above. As seen from above, the suspension 79 supports a front left side part of the water tub 74, the suspension 80 supports a front right side part of the water tub 74, and the suspension 81 supports a rear central part of the water tub 74. One ends of the suspensions 79, 80, and 81 are respectively coupled to a left side part, a right side part, and a central part of the suspension fitting portion 17. The other ends of the suspensions 79, 80, and 81 are respectively coupled to the suspension fitting portions 67, 68, and 76 provided on the outer circumference surface of the water tub 74.

The suspension fitting portion 17, which is arranged in a central part, in the front/rear direction of the drum-type washing machine, of the bottom surface (facing the inside of the cabinet 60) of the top plate 2, is arranged, as in the first embodiment, so as to be located behind and above the suspension fitting portion 67 (68). Moreover, the suspension fitting portion 17 is arranged in front of and above the suspension fitting portion 76. That is, as shown in FIG. 7, the suspension 79 (80) is so arranged that the direction in which the suspension 79 (80) supports, i.e. the direction running from where it is fitted to the water tub 74 toward the suspension fitting portion 17, forms an angle of $\theta 5(0° < \theta 5 < 90°)$ with respect to a horizontal axis running in the front/rear direction. On the other hand, the suspension 81 is so arranged that the direction in which the suspension 81 supports, i.e. the direction running from where it is fitted to the water tub 74 toward the suspension fitting portion 17, forms an angle of $\theta 6(0° < \theta 6 < 90°)$ with respect to a horizontal axis running in the front/rear direction. That is, as seen from a side, the suspensions 79 (80) and 81 are so fitted as to be increasingly close to each other upward. Moreover, as shown in FIG. 7, the suspension fitting portion 17 is arranged in front of the center of gravity G3 of the vibrating body load 83, which will be described later, as present when laundry has the rated weight. This allows the suspension 79 (80) to more effectively lift the front part of the water tub 74. Moreover, as in the first embodiment, as seen from above, the suspensions 79, 80, and 81 are arranged parallel to the front/rear direction of the drum-type washing machine.

In this drum-type washing machine, the structural load 82 is constituted by the water tub 74, the drum 34, the motor 36, the heater portion 40, the heat exchange plate (unillustrated in this embodiment, but arranged on the left of the heater portion 40 as in FIG. 3 of the first embodiment), the blowing fan 42, and the liquid balancer 37. Let g4 represent the center of gravity of the structural load 82, let g2 represent the center of gravity of the laundering load 56 as present when laundry having the rated weighted is put in, and let G3 represent the center of gravity of the vibrating body load 83 constituted by the structural load 82 and the laundering load 56 considered together. Then, as shown in FIG. 7, the dampers 50 and 51 are so arranged as to support the center of gravity g4 of the structural load 82.

In this drum-type washing machine, when the laundering load 56 is put in, the center of gravity of the vibrating body load 83 is located in front of the axis P5-P6. Thus, the front part of the water tub 74 located in front of the axis P5-P6 tends to be displaced downward, and the rear part of the water tub 74 located behind the axis P5-P6 tends to be displaced upward. That is, in the vertical cross-sectional view of FIG. 7 as seen from the right side, the vibrating body load 83 develops a counter-clockwise momentum about the axis P5-P6, and thus the water tub 74 rotates counter-clockwise about the axis P5-P6. In addition to this rotational displacement, the weight of the laundering load 56 as present when laundry having the rated weight is put in acts to make the dampers 50 and 51 contract, causing the water tub 74 as a whole to be displaced further downward.

In the drum-type washing machine of the third embodiment, the center of gravity of the laundering load 56 is located below and in front of the center of gravity g4 of the structural load 82. Thus, as the weight of the laundering load 56 increases, the center of gravity of the vibrating body load 71 shifts frontward, and thus the sinking displacement of the front part of the water tub 74 increases. The suspensions 79 and 80 pull the front part of the water tub 74 upward-rearward; that is, they exert a tensile force that makes the water tub 74 rotate clockwise about the axis P5-P6 passing through the connecting position P5 between the damper fitting portion 77 and the damper 50 and the connecting position P6 between the damper fitting portion 78 and the damper 51. Thus, the counter-clockwise rotation of the water tub 74 about the axis P5-P6 can be effectively prevented. Moreover, by pulling upward, the suspensions 79, 80, and 81 prevent the front part of the water tub 74 from sinking. In this drum-type washing machine, except for instantaneous shifts of the center of gravity of the laundering load 56, it does not occur that the water tub 74 rotates clockwise about the axis P5-P6. That is, the sinking of the rear part of the water tub 74 does not occur steadily. This makes it possible to use a coil spring having a low spring constant as the suspension 81 or even omit the suspension 81.

Fourth Embodiment of the Present Invention

Figure 8:
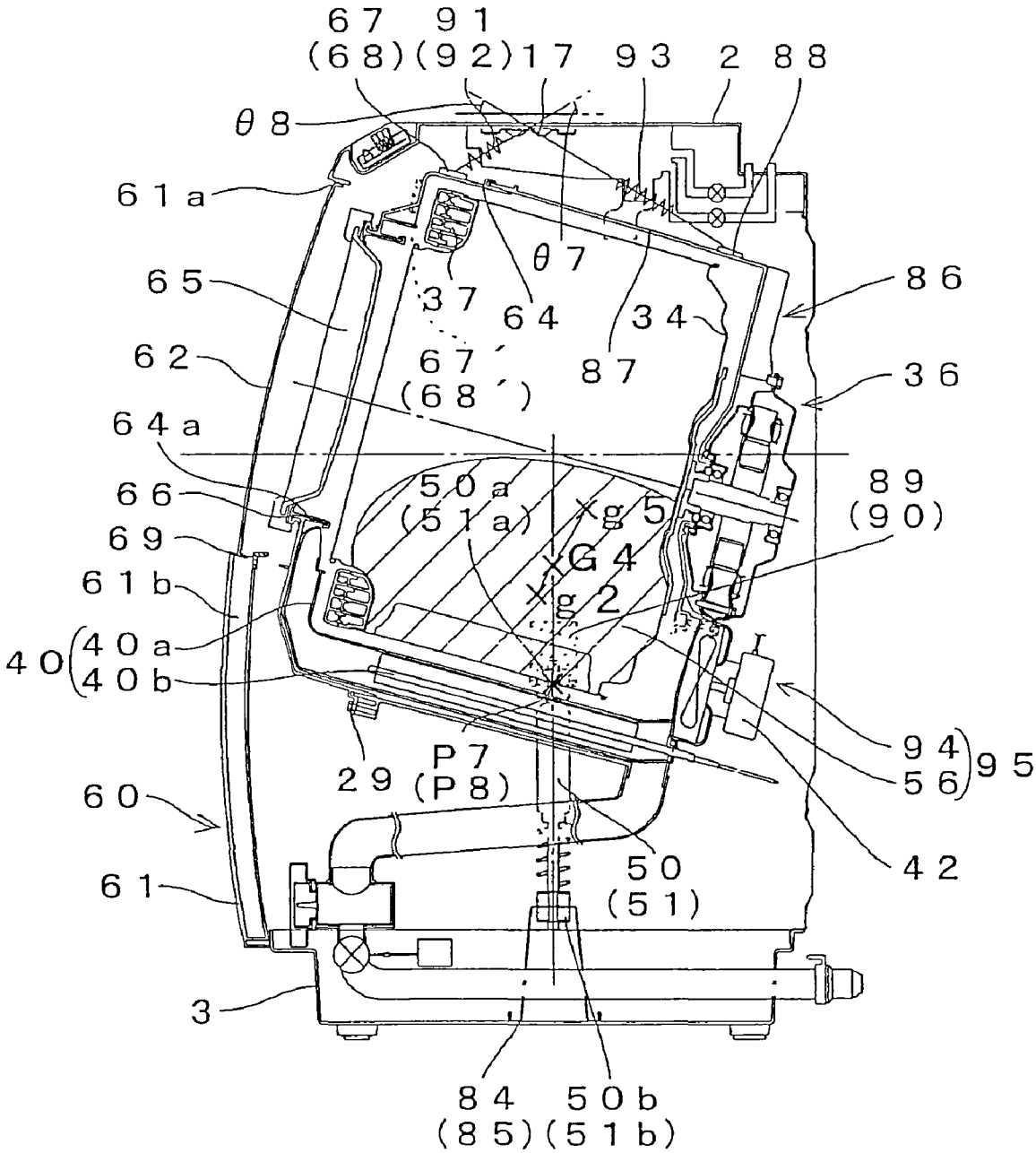
FIG. 8 A schematic vertical cross-sectional view of the drum-type washing machine of a fourth embodiment of the present invention, as seen from a side.

Next, the drum-type washing machine of a fourth embodiment of the present invention will be described with reference to FIG. 8. FIG. 8 is a schematic vertical cross-sectional view of the drum-type washing machine of the fourth embodiment of the present invention, as seen from a side. In the following description of the fourth embodiment, such parts as are found also in the third embodiment described above are identified by common reference numerals, and no overlapping description will be repeated; that is, the fourth embodiment will be described in terms of its features different from the third embodiment.

As shown in FIG. 8, the drum-type washing machine of the fourth embodiment of the present invention has a cabinet 60 that forms the exterior surface thereof. A lower part of the cabinet 60 is formed by a bottom stand 3, and, as shown in FIG. 8, on the bottom stand 3, on the upper surface of the bottom face thereof, damper fitting portions 84 and 85 are provided to which are coupled one ends of dampers 50 and 51, which will be described later. The damper fitting portion 84 is arranged on the left, and the damper fitting portion 85 is arranged on the right; as in the first embodiment, the damper fitting portions 84 and 85 are arranged to be located, as seen from a side, at the same position.

Inside the cabinet 60, a water tub 86 having the shape of a bottomed cylinder is arranged so that a rear part thereof is 5° to 30° inclined downward with respect to a horizontal plane. The water tub 86 is built by coupling together a front section 64, which forms a front part of the water tub 86 along the axis thereof, and a rear section 87, which forms a rear part of the water tub 86 along the axis thereof, with screws 29. As in the first embodiment, on the rear section 87, in an upper part of the outer circumferential surface thereof, in a rear-central part thereof, a suspension fitting portion 88 is provided to which is coupled one end of a suspension 93, which will be described later. Moreover, as in the first embodiment, on the rear section 87, in a lower part of the outer circumferential surface thereof, damper fitting portions 89 and 90 are provided to which are coupled one ends of dampers 50 and 51. The damper fitting portion 89 is arranged on the left, and the damper fitting portion 90 is arranged on the right; as in the first embodiment, the damper fitting portions 89 and 90 are arranged to be located, as seen from a side, at the same position.

One ends of the dampers 50 and 51 are respectively coupled, via elastic members 50*a* and 51*a*, to the damper fitting portions 89 and 90 provided on the outer circumferential surface of the water tub 86. The other ends of the dampers 50 and 51 are respectively coupled, via elastic members 50*b* and 51*b*, to the damper fitting portions 84 and 85 provided on the bottom face of the bottom stand 3. Thus, the dampers 50 and 51 elastically support, by pressing upward, the water tub 86. The coupling between the dampers 50 and 51 and the water tub 86 and between the dampers 50 and 51 and the cabinet 60 is achieved via the elastic members 50*a*, 51*a*, 50*b*, and 51*b*. This contributes to reduced propagation of vibrations from the water tub 86 to the cabinet 60 and further to the floor.

The damper fitting portion 84 is arranged on the left of the damper fitting portion 89, and the damper fitting portion 85 is arranged on the right of the damper fitting portion 90; that is, as seen from in front, the dampers 50 and 51 are so fitted as to be increasingly close to each other upward. As seen from a side, the damper fitting portions 84 and 85 are arranged at the same position in the front/rear and up/down directions; the damper fitting portions 89 and 90 are arranged at the same position in the front/rear and up/down directions; the damper fitting portions 84 and 85 are respectively arranged vertically below the damper fitting portions 89 and 90. Thus, the axis P7-P8 passing through the connecting position P7 (corresponding to P1 shown in FIG. 4) between the damper fitting portion 89 and the damper 50 and the connecting position P8 (corresponding to P2 shown in FIG. 4) between the damper fitting portion 90 and the damper 51 is parallel to a horizontal axis that runs in the left/right direction of the drum-type washing machine. Moreover, the dampers 50 and 51 are so arranged that the directions in which they elastically support lie on the same vertical plane.

Outside the water tub 86, above it, three suspensions 91, 92, and 93 are arranged that serve as suspending device for elastically supporting, by suspending downward, the water tub 86 from above. As seen from above, the suspension 91 supports a front left side part of the water tub 86, the suspension 92 supports a front right side part of the water tub 86, and the suspension 93 supports a rear central part of the water tub 86. One ends of the suspensions 91, 92, and 93 are respectively coupled to a left side part, a right side part, and a central part of the suspension fitting portion 17. The other ends of the suspensions 91, 92, and 93 are respectively coupled to the suspension fitting portions 67, 68, and 76 provided on the outer circumference surface of the water tub 86.

The suspension fitting portion 17, which is arranged in a central part, in the front/rear direction of the drum-type washing machine, of the bottom surface (facing the inside of the cabinet 60) of the top plate 2, is arranged, as in the first embodiment, so as to be located behind and above the suspension fitting portion 67 (68). Moreover, the suspension fitting portion 17 is arranged in front of and above the suspension fitting portion 88. That is, as shown in FIG. 8, the suspension 91 (92) is so arranged that the direction in which the suspension 91 (92) supports, i.e. the direction running from where it is fitted to the water tub 86 toward the suspension fitting portion 17, forms an angle of $\theta 7(0° < \theta 7 < 90°)$ with respect to a horizontal axis running in the front/rear direction. On the other hand, the suspension 93 is so arranged that the direction in which the suspension 93 supports, i.e. the direction running from where it is fitted to the water tub 86 toward the suspension fitting portion 17, forms an angle of $\theta 8(0° < \theta 8 < 90°)$ with respect to a horizontal axis running in the front/rear direction. That is, as seen from a side, the suspensions 91 (92) and 93 are so fitted as to be increasingly close to each other upward. Moreover, as shown in FIG. 8, the suspension fitting portion 17 is arranged in front of the center of gravity G4 of the vibrating body load 95, which will be described later, as present when laundry has the rated weight. This allows the suspension 91 (92) to more effectively lift the front part of the water tub 86. Moreover, as in the first embodiment, as seen from above, the suspensions 91, 92, and 93 are arranged parallel to the front/rear direction of the drum-type washing machine.

In this drum-type washing machine, the structural load 94 is constituted by the water tub 86, the drum 34, the motor 36, the heater portion 40, the heat exchange plate (unillustrated in this embodiment, but arranged on the left of the heater portion 40 as in FIG. 3 of the first embodiment), the blowing fan 42, and the liquid balancer 37. Let g5 represent the center of gravity of the structural load 94, let g2 represent the center of gravity of the laundering load 56 as present when laundry having the rated weighted is put in, and let G4 represent the center of gravity of the vibrating body load 95 constituted by the structural load 94 and the laundering load 56 considered together. Then, as shown in FIG. 8, the dampers 50 and 51 are so arranged as to support the center of gravity G4 of the vibrating body load 95.

In this drum-type washing machine, unless the laundering load 56 having the rated weight is put in, the center of gravity of the vibrating body load 95 is located behind the axis P7-P8. Thus, the front part of the water tub 86 located in front of the axis P7-P8 tends to be displaced upward, and the rear part of the water tub 86 located behind the axis P7-P8 tends to be displaced downward. That is, in the vertical cross-sectional view of FIG. 8 as seen from the right side, the vibrating body load 95 develops a clockwise momentum about the axis P7-P8, and thus the water tub 86 rotates counter-clockwise about the axis P7-P8. In addition to this rotational displacement, the weight of the laundering load 56 as present when laundry having the rated weight is put in acts to make the dampers 50 and 51 contract, causing the water tub 74 as a whole to be displaced further downward.

In the drum-type washing machine of the fourth embodiment, the suspension 93 pulls the rear part of the water tub 86 upward-frontward; that is, it exerts a tensile force that makes the water tub 86 rotate counter-clockwise about the axis P7-P8 passing through the connecting position P7 between the damper fitting portion 89 and the damper 50 and the connecting position P8 between the damper fitting portion 90 and the damper 51. Thus, the clockwise rotation of the water tub 86 about the axis P7-P8 can be effectively prevented. Moreover, by pulling upward, the suspensions 91, 92, and 93 prevent the front part of the water tub 86 from sinking. In this drum-type washing machine, except for instantaneous shifts of the center of gravity of the laundering load 56, it does not occur that the water tub 86 rotates clockwise about the axis P7-P8. That is, the sinking of the front part of the water tub 86 does not occur steadily. This makes it possible to use coil springs having a low spring constant as the suspensions 91 and 92 or even omit the suspensions 91 and 92.

In the drum-type washing machines of the first to fourth embodiments of the present invention described above, two dampers are used as a damping device for elastically supporting, by pressing upward, the water tub from below. In a case where no consideration needs to be given to left/right-direction vibrations of the water tub, only one damper may be used to support, vertically upward, between the center of gravity g1, g3, g4, or g5 of the laundering load and the center of gravity G1, G2, G3, or G4 of the vibrating body load.

Fifth Embodiment of the Present Invention

Figure 9:
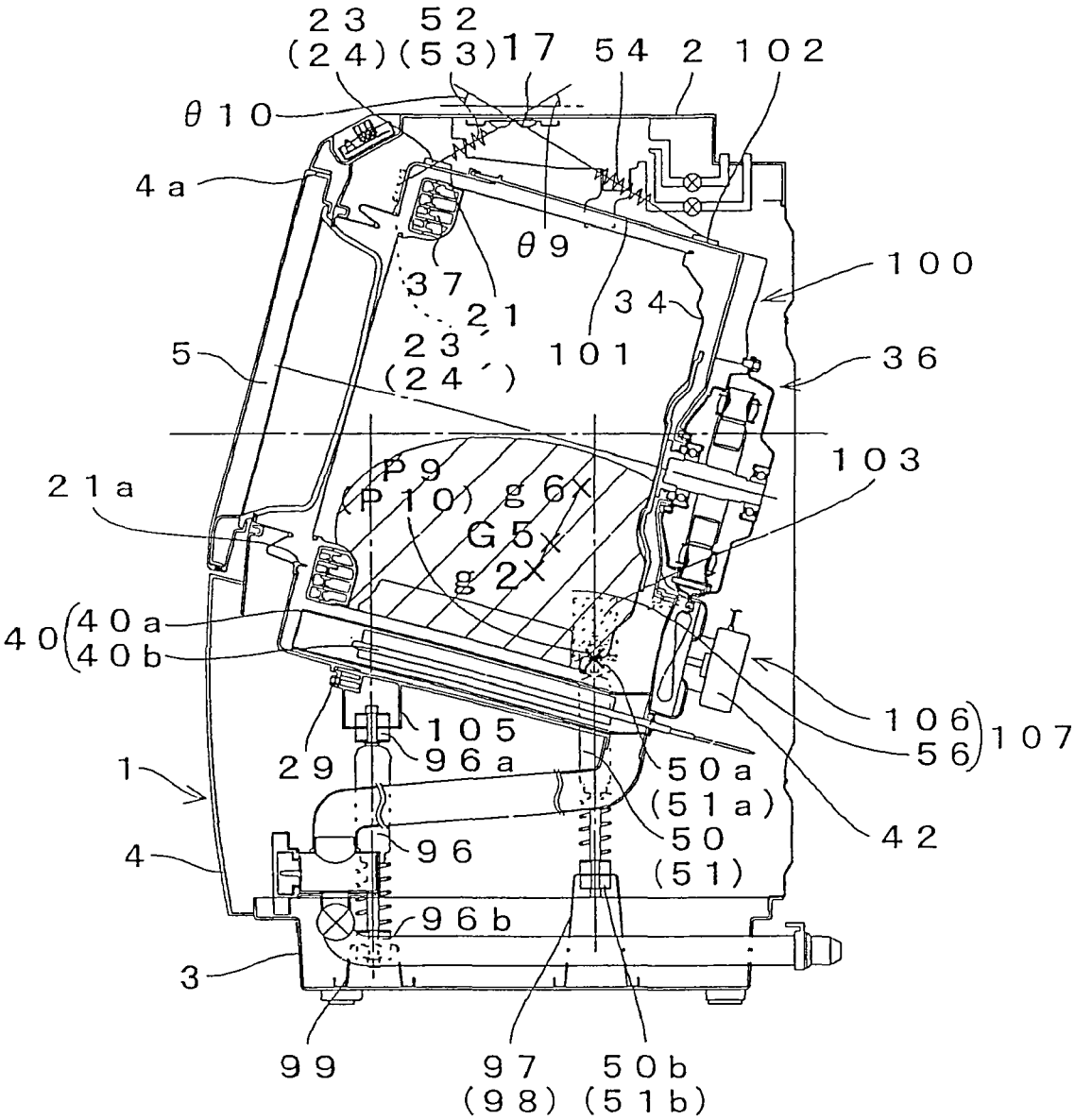
FIG. 9 A schematic vertical cross-sectional view of the drum-type washing machine of a fifth embodiment of the present invention, as seen from a side.

Next, the drum-type washing machine of a fifth embodiment of the present invention will be described with reference to FIGS. 9 and 10. FIG. 9 is a schematic vertical cross-sectional view of the drum-type washing machine of the fifth embodiment of the present invention, as seen from a side. In the following description of the fifth embodiment, such parts as are found also in the first embodiment described earlier are identified by common reference numerals, and no overlapping description will be repeated; that is, the fifth embodiment will be described in terms of its features different from the first embodiment.

As shown in FIG. 9, the drum-type washing machine of the fifth embodiment of the present invention has a cabinet 1 that forms the exterior surface thereof. A lower part of the cabinet 1 is formed by a bottom stand 3, and, as shown in FIG. 9, on the bottom stand 3, on the upper surface of the bottom face thereof, damper fitting portions 97, 98, and 99 are provided to which are coupled one ends of dampers 50, 51, and 96, which will be described later. The damper fitting portion 97 is arranged at the rear left, the damper fitting portion 98 at the rear right, and the damper fitting portion 99 at the front center. As seen from a side, the damper fitting portions 97 and 98 are located at the same position.

Inside the cabinet 1, a water tub 100 having the shape of a bottomed cylinder is arranged so that a rear part thereof is 5° to 30° inclined downward with respect to a horizontal plane. The water tub 100 is built by coupling together a front section 21, which forms a front part of the water tub 100 along the axis thereof, and a rear section 101, which forms a rear part of the water tub 100 along the axis thereof, with screws 29. As in the first embodiment, on the rear section 101, in an upper part of the outer circumferential surface thereof, in a rear-central part thereof, a suspension fitting portion 102 is provided to which is coupled one end of a suspension 54. Moreover, on the rear section 101, in a lower part of the outer circumferential surface thereof, damper fitting portions 103, 104, and 105 are provided to which are coupled one ends of dampers 50, 51, and 96. The damper fitting portion 103 is arranged at the rear left, the damper fitting portion 104 at the rear right, and the damper fitting portion 105 at the front center. As seen from a side, the damper fitting portions 103 and 104 are located at the same position.

Outside the water tub 100, under it, two dampers 50 and 51 are arranged that serve as a damping device for elastically supporting, by pressing upward, the rear part of the water tub 100 from below, and another damper 96 is arranged that also serves as a damping device for elastically supporting, by pressing upward, the front part of the water tub 100 from below. As shown in FIG. 10, as seen from in front, the damper 50 supports a left side part of the water tub 100, and the damper 51 supports a right side part of the water tub 100. One ends of the dampers 50, 51, and 96 are respectively coupled, via elastic members 50*a*, 51*a*, and 96*a*, to the damper fitting portions 103, 104, and 105 provided on the outer circumferential surface of the water tub 100. The other ends of the dampers 50, 51, and 96 are coupled, via elastic members 50*b*, 51*b*, and 96*b*, to the damper fitting portions 97, 98, and 99 provided on the bottom face of the bottom stand 3. Thus, the dampers 50, 51, and 96 elastically support, by pressing upward, the water tub 100. The coupling between the dampers 50, 51, and 96 and the water tub 100 and between the dampers 50, 51, and 96 and the cabinet 1 is achieved via the elastic members 50*a*, 51*a*, 96*a*, 50*b*, 51*b*, and 96*b*. This contributes to reduced propagation of vibrations from the water tub 100 to the cabinet 1 and further to the floor.

Figure 10:
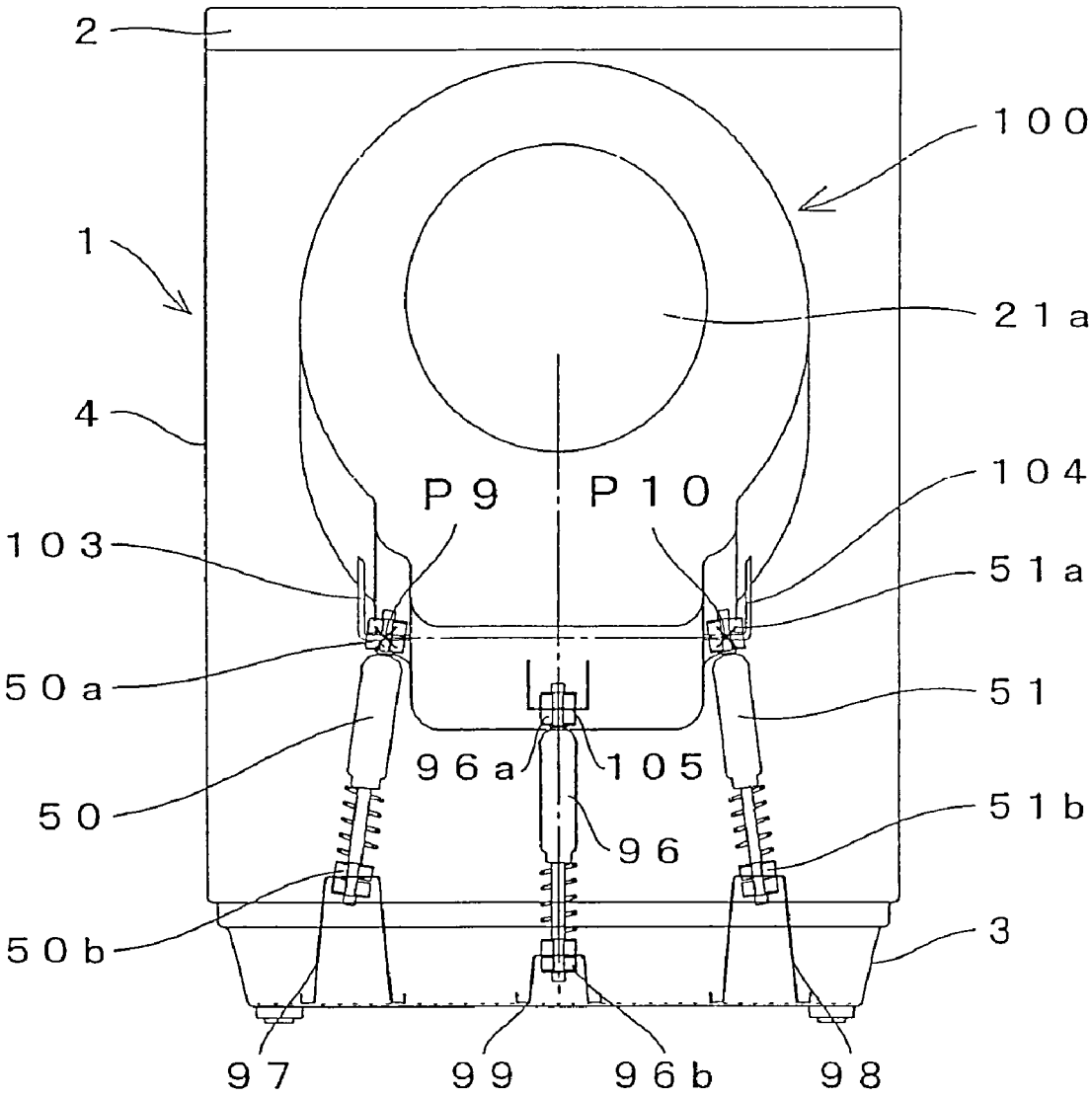
FIG. 10 A schematic vertical cross-sectional view of the drum-type washing machine of the fifth embodiment of the present invention, showing the water tub supporting structure as seen from the front.
Figure 11D:
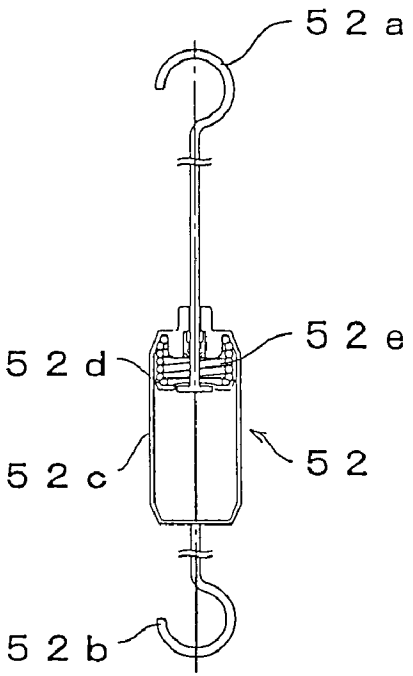
FIG. 11 A schematic diagram showing the suspensions and dampers used in the drum-type washing machine of the fifth embodiment of the present invention.
Figure 11C:
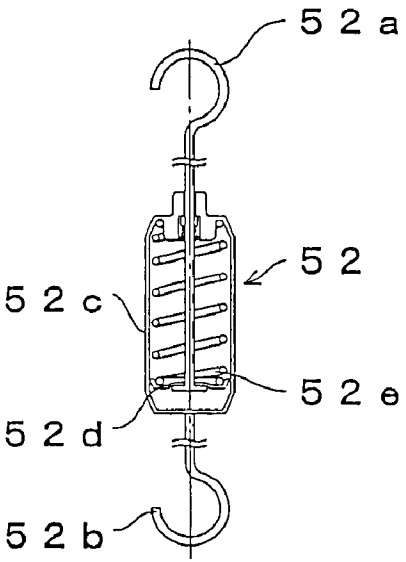
Figure 11B:
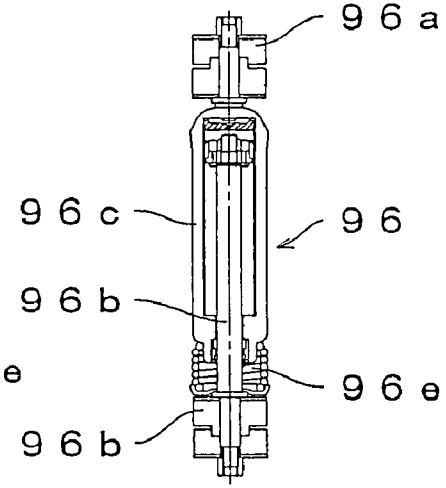
Figure 11A:
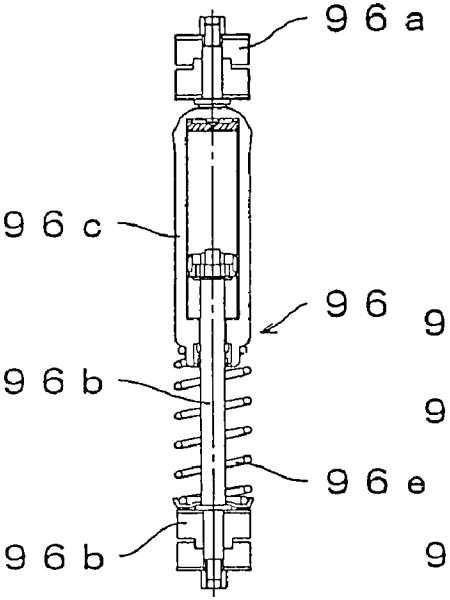

As shown in FIG. 10, as seen from in front, the damper fitting portion 97 is arranged on the left of the damper fitting portion 103, and the damper fitting portion 98 is arranged on the right of the damper fitting portion 104; that is, as seen from in front, the dampers 50 and 51 are so fitted as to be increasingly close to each other upward. As seen from a side, the damper fitting portions 97 and 98 are arranged at the same position in the front/rear and up/down directions, and, likewise, the damper fitting portions 103 and 104 are arranged at the same position in the front/rear and up/down directions; the damper fitting portions 97 and 98 are respectively arranged vertically below the damper fitting portions 103 and 104. Moreover, as seen in FIGS. 9 and 10, as seen both from in front and from a side, the damper fitting portion 99 is arranged vertically below the damper fitting portion 105. Thus, the axis P9-P10 (see FIG. 10) passing through the connecting position P9 (see FIGS. 9 and 10) between the damper fitting portion 103 and the damper 50 and the connecting position P10 (see FIG. 10) between the damper fitting portion 104 and the damper 51 is parallel to a horizontal axis that runs in the left/right direction of the drum-type washing machine. Moreover, the dampers 50 and 51 are so arranged that the directions in which they elastically support lie on the same vertical plane.

Outside the water tub 100, above it, three suspensions 52, 53, and 54 are arranged that serve as a suspending device for elastically supporting, by suspending downward, the water tub 100 from above. As in the first embodiment, as seen from above, the suspension 52 supports a front left side part of the water tub 100, the suspension 53 supports a front right side part of the water tub 100, and the suspension 54 supports a rear central part of the water tub 100. One ends of the suspensions 52, 53, and 54 are respectively coupled to a left side part, a right side part, and a central part of the suspension fitting portion 17. The other ends of the suspensions 52, 53, and 54 are respectively coupled to the suspension fitting portions 23, 24, and 102 provided on the outer circumference surface of the water tub 100. Thus, the suspensions 52, 53, and 54 elastically support, by suspending downward, the water tub 100. This contributes to reduced rotation of the water tub 100, and to reduced propagation of vibrations from the water tub 100 to the cabinet 1 and further to the floor.

Now, with reference to FIG. 11, a description will be given of an example of the damper 96 that supports the front part of the water tub from below in the fifth and sixth (described later) embodiments and an example of the suspensions 52, 53, 67, and 68 that support the front part of the water tub from upward in the first to sixth embodiments. FIGS. 11(*a*) and 11(*b*) are schematic cross-sectional views of the damper 96 in its expanded and contracted states, respectively. FIGS. 11(*c*) and 11(*d*) are schematic cross-sectional views of the suspension 52 in its contracted and expanded states, respectively. The suspensions 53, 67, and 68 have the same structure as the suspension 52, and therefore no separate description thereof will be given. As shown in FIG. 11(*a*), the damper 96 is provided with elastic members 96*a* and 96*b* of which an upper end part and a lower end part, respectively, are connected to the water tub and to the cabinet. The damper 96 is further provided with a cylinder 96*c*, a piston 96*d*, and a coil spring 96*e*. The cylinder 96*c* is arranged between the elastic members 96*a* and 96*b*, and has oil seal therein. The tip end of the piston 96*d* fits into the cylinder 96*c*, allowing the piston 96*d* to slide and thereby exert a damping effect. The coil spring 96*e* has the piston 96*d* put therethrough, inside the inner diameter thereof, and elastically supports between a lower end part of the outer surface of the damper 96 and an upper end part of the elastic member 96*b*. When the front part of the water tub is displaced downward beyond a predetermined distance and thus the damper 96 changes its state from the expanded state shown in FIG. 11(*a*) to the contracted state shown in FIG. 11(*b*), adjacent turns of the wire forming the coil spring 96*e* make contact with one another, preventing it from further contracting. That is, the damper 96 acts to restrict the downward displacement of the front part of the water tub, and the coil spring 96*e* functions as the stopper therefor.

As shown in FIG. 11(*c*), the suspension 52 is provided with connecting portions 52*a* and 52*b* of which an upper end part and a lower end part, respectively, are connected to the cabinet and to the water tub. The suspension 52 is further provided with a cylinder 52*c*, a flange portion 52*d*, and a coil spring 52*e*. The cylinder 52*c* is arranged between the connecting portions 52*a* and 52*b*, and a lower end part of the connecting portion 52*a* fits into the cylinder 52*c*. The flange portion 52*d* is enclosed in the cylinder 52*c*, and is arranged at the lower end of the connecting portion 52*a*. The coil spring 52*e* elastically supports between an upper end part of the inner surface of the cylinder 52*c* and the upper surface of the flange portion 52*d*. When the front part of the water tub is displaced downward beyond a predetermined distance and thus the suspension 52 changes its state from the contracted state shown in FIG. 11(*c*) to the expanded state shown in FIG. 11(*d*), adjacent turns of the wire forming the coil spring 52*e* make contact with one another, preventing it from further expanding. That is, like the damper 96, the suspension 52 acts to restrict the downward displacement of the front part of the water tub, and the coil spring 52*e* functions as the stopper therefor. In this way, with the damper 96 and the suspension 52 functioning as stoppers, the counter-clockwise rotation of the water tub as seen in the schematic side views of FIGS. 2, 6, 7, 8, 9, and 12 is restricted, with the result that the water tub, as it vibrates, is prevented from making contact with the cabinet.

Moreover, as shown in FIG. 9, the suspension fitting portion 17 is arranged behind and above the suspension fitting portion 23 (24), and is arranged in front of and above the suspension fitting portion 102. That is, as shown in FIG. 9, the suspension 52 (53) is so arranged that the direction in which the suspension 52 (53) supports, i.e. the direction running from where it is fitted to the water tub 100 toward the suspension fitting portion 17, forms an angle of $\theta 9(0° < \theta 9 < 90°)$ with respect to a horizontal axis running in the front/rear direction. On the other hand, the suspension 54 is so arranged that the direction in which the suspension 54 supports, i.e. the direction running from where it is fitted to the water tub 100 toward the suspension fitting portion 17, forms an angle of $\theta 10$ $(0° < \theta 10 < 90°)$ with respect to a horizontal axis running in the front/rear direction. That is, as seen from a side, the suspensions 52 (53) and 54 are so fitted as to be increasingly close to each other upward. Moreover, as shown in FIG. 9, the suspension fitting portion 17 is arranged in front of the center of gravity G5 of the vibrating body load 107, which will be described later. This allows the suspension 52 (53) to more effectively lift the front part of the water tub 100. Moreover, as in the first embodiment, as seen from above, the suspensions 52, 53, and 54 are arranged parallel to the front/rear direction of the drum-type washing machine.

In this drum-type washing machine, the structural load 106 is constituted by the water tub 100, the drum 34, the motor 36, the heater portion 40, the heat exchange plate (unillustrated in this embodiment, but arranged on the left of the heater portion 40 as in FIG. 3 of the first embodiment), the blowing fan 42, and the liquid balancer 37. Let g6 represent the center of gravity of the structural load 106, let g2 represent the center of gravity of the laundering load 56 as present when laundry having the rated weighted is put in, and let G5 represent the center of gravity of the vibrating body load 107 constituted by the structural load 106 and the laundering load 56 considered together. Then, as shown in FIG. 9, the dampers 50 and 51 are so arranged as to support behind the center of gravity g6 of the structural load 106. Specifically, this means that the intersection between the vertical plane on which the axes of direction in which the dampers 50 and 51 support lie and the line running from the center of gravity G5 of the vibrating body load 107 toward the center of gravity g6 of the structural load 106 is located behind the position g6.

Moreover, as shown in FIG. 9, the damper 96 is so arranged as to support in front of the center of gravity G5 of the vibrating body load 107. Specifically, this means that the intersection between the axis of direction in which the damper 96 supports and the horizontal plane on which the center of gravity G5 of the vibrating body load 107 lies is located in front of the center of gravity G5 of the vibrating body load 107.

In this drum-type washing machine, the center of gravity of the vibrating body load 107 is located in front of the axis P9-P10. Thus, the front part of the water tub 100 located in front of the axis P9-P10 tends to be displaced downward, and the rear part of the water tub 100 located behind the axis P9-P10 tends to be displaced upward. That is, in the vertical cross-sectional view of FIG. 9 as seen from the right side, the vibrating body load 107 develops a counter-clockwise momentum about the axis P9-P10, and thus the water tub 100 rotates counter-clockwise about the axis P9-P10. In addition to this rotational displacement, the weight of the laundering load 56 acts to make the dampers 50 and 51 contract, causing the water tub 100 as a whole to be displaced further downward. This tends to make the sinking displacement of the front part of the water tub 100 large, making it essential to reduce the sinking of the front part of the water tub 100.

In the drum-type washing machine of the fifth embodiment, as in the first embodiment, the rotation of the water tub 100 about the axis P9-P10 and the sinking thereof can be effectively prevented, and in addition the damper 96 reduces the vibrations of the front part of the water tub 100. Thus, even if abnormal vibrations occur, they can be suppressed at an early stage.

Sixth Embodiment of the Present Invention

Figure 12:
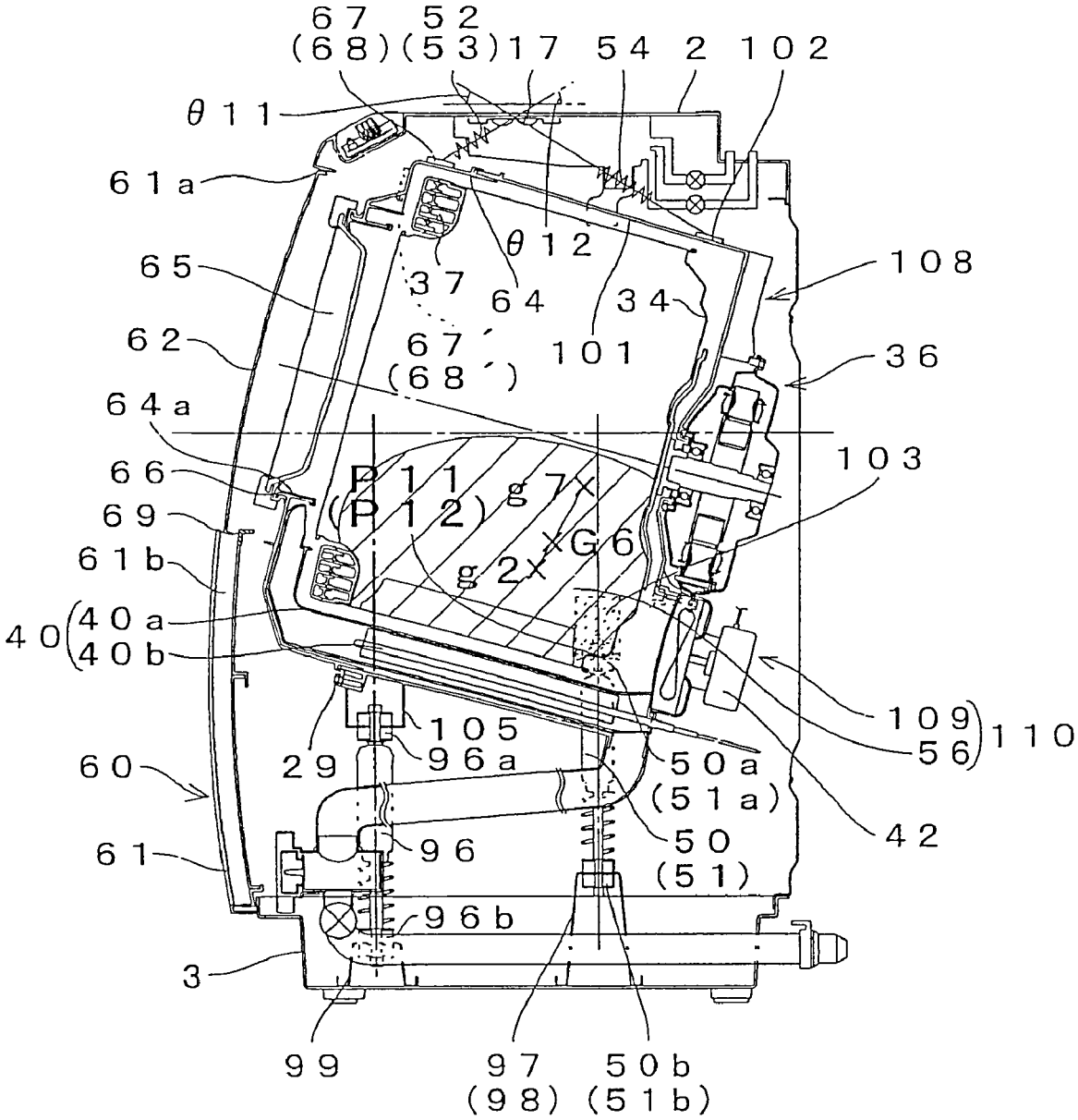
FIG. 12 A schematic vertical cross-sectional view of the drum-type washing machine of a sixth embodiment of the present invention, as seen from a side.
Figure 13:
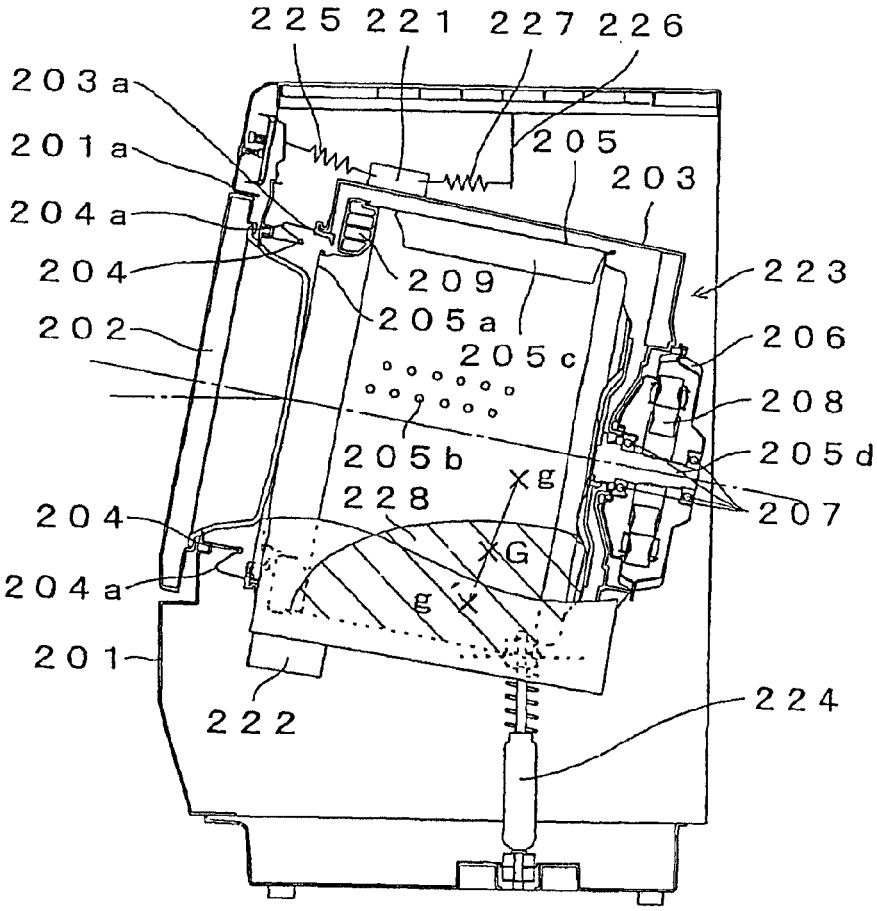
FIG.13 CONVENTIONAL ART
FIG. 13 A schematic vertical cross-sectional view of a conventional drum-type washing machine, as seen from a side.
Figure 14:
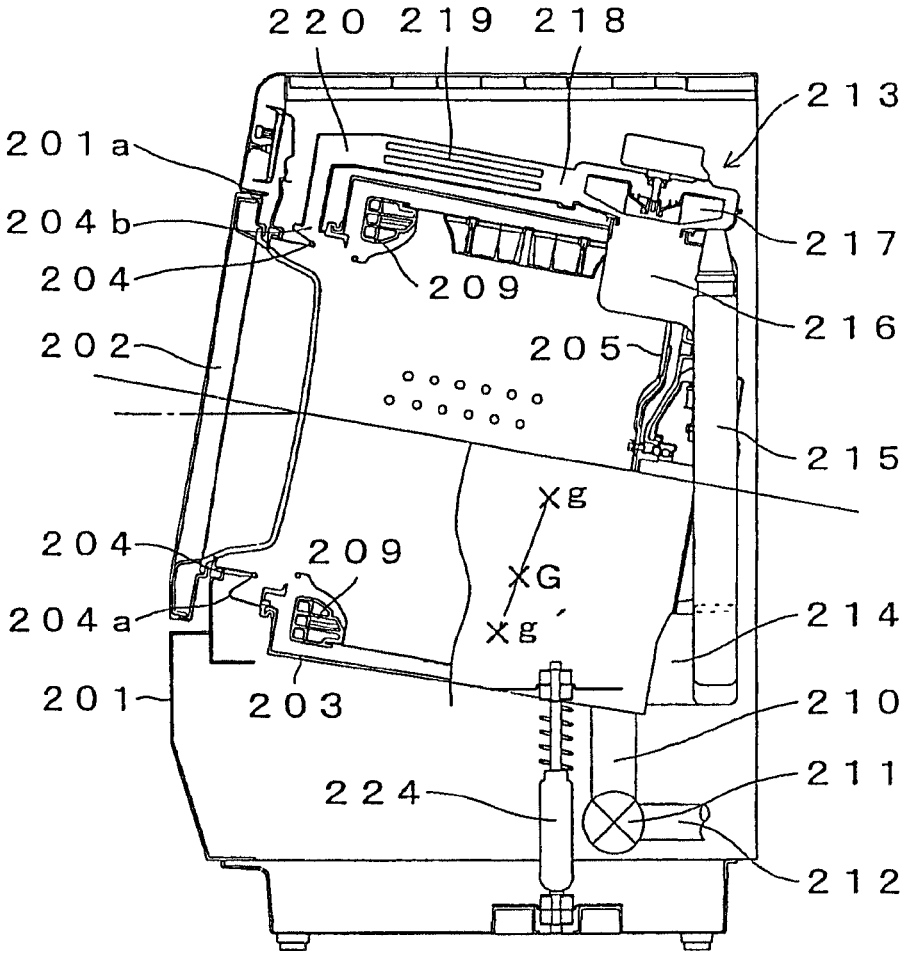
FIG.14 CONVENTIONAL ART
FIG. 14 A schematic vertical cross-sectional view of the conventional drum-type washing machine as seen from the same side but at a different cross-section

Next, the drum-type washing machine of a sixth embodiment of the present invention will be described with reference to FIG. 12. FIG. 12 is a schematic vertical cross-sectional view of the drum-type washing machine of the sixth embodiment of the present invention, as seen from a side. In the following description of the sixth embodiment, such parts as are found also in the second and fifth embodiments described above are identified by common reference numerals, and no overlapping description will be repeated; that is, the sixth embodiment will be described in terms of its features different from the second and fifth embodiments.

As shown in FIG. 12, the drum-type washing machine of the sixth embodiment of the present invention has a cabinet 60 that forms the exterior surface thereof. A lower part of the cabinet 60 is formed by a bottom stand 3, and, as shown in FIG. 12, on the bottom stand 3, on the upper surface of the bottom face thereof, damper fitting portions 97, 98, and 99 are provided to which are coupled one ends of dampers 50, 51, and 96, which will be described later.

Inside the cabinet 60, a water tub 108 having the shape of a bottomed cylinder is arranged so that a rear part thereof is 5° to 30° inclined downward with respect to a horizontal plane. The water tub 108 is built by coupling together a front section 63, which forms a front part of the water tub 108 along the axis thereof, and a rear section 101, which forms a rear part of the water tub 100 along the axis thereof, with screws 29.

Outside the water tub 108, under it, two dampers 50 and 51 are arranged that serve as a damping device for elastically supporting, by pressing upward, the rear part of the water tub 108 from below, and another damper 96 is arranged that also serves as a damping device for elastically supporting, by pressing upward, the front part of the water tub 108 from below. As in the fifth embodiment, as seen from in front, the damper 50 supports a left side part of the water tub 108, and the damper 51 supports a right side part of the water tub 108. One ends of the dampers 50, 51, and 96 are respectively coupled, via elastic members 50*a*, 51*a*, and 96*a*, to the damper fitting portions 103, 104, and 105 provided on the outer circumferential surface of the water tub 108. The other ends of the dampers 50, 51, and 96 are coupled, via elastic members 50*b*, 51*b*, and 96*b*, to the damper fitting portions 97, 98, and 99 provided on the bottom face of the bottom stand 3. Thus, the dampers 50, 51, and 96 elastically support, by pressing upward, the water tub 108. The coupling between the dampers 50, 51, and 96 and the water tub 108 and between the dampers 50, 51, and 96 and the cabinet 60 is achieved via the elastic members 50*a*, 51*a*, 96*a*, 50*b*, 51*b*, and 96*b*. This contributes to reduced propagation of vibrations from the water tub 108 to the cabinet 60 and further to the floor.

As in the fifth embodiment, as seen from in front, the damper fitting portion 97 is arranged on the left of the damper fitting portion 103, and the damper fitting portion 98 is arranged on the right of the damper fitting portion 104; that is, as seen from in front, the dampers 50 and 51 are so fitted as to be increasingly close to each other upward. As seen from a side, the damper fitting portions 97 and 98 are arranged at the same position in the front/rear and up/down directions, and, likewise, the damper fitting portions 103 and 104 are arranged at the same position in the front/rear and up/down directions; the damper fitting portions 97 and 98 are respectively arranged vertically below the damper fitting portions 103 and 104. Moreover, as in the fifth embodiment, as seen both from in front and from a side, the damper fitting portion 99 is arranged vertically below the damper fitting portion 105. Thus, the axis P11-P12 passing through the connecting position P11 (corresponding to P9 shown in FIG. 10) between the damper fitting portion 103 and the damper 50 and the connecting position P12 (corresponding to P10 shown in FIG. 10) between the damper fitting portion 104 and the damper 51 is parallel to a horizontal axis that runs in the left/right direction of the drum-type washing machine. Moreover, the dampers 50 and 51 are so arranged that the directions in which they elastically support lie on the same vertical plane.

Outside the water tub 108, above it, three suspensions 52, 53, and 54 are arranged that serve as a suspending device for elastically supporting, by suspending downward, the water tub 108 from above. As in the fifth embodiment, as seen from above, the suspension 52 supports a front left side part of the water tub 108, the suspension 53 supports a front right side part of the water tub 108, and the suspension 54 supports a rear central part of the water tub 108. One ends of the suspensions 52, 53, and 54 are respectively coupled to a left side part, a right side part, and a central part of the suspension fitting portion 17. The other ends of the suspensions 52, 53, and 54 are respectively coupled to the suspension fitting portions 67, 68, and 102 provided on the outer circumference surface of the water tub 100. Thus, the suspensions 52, 53, and 54 elastically support, by suspending downward, the water tub 108. This contributes to reduced propagation of vibrations from the water tub 108 to the cabinet 60 and further to the floor.

Moreover, as shown in FIG. 12, the suspension fitting portion 17 is arranged behind and above the suspension fitting portion 67 (68), and is arranged in front of and above the suspension fitting portion 102. That is, as shown in FIG. 12, the suspension 52 (53) is so arranged that the direction in which the suspension 52 (53) supports, i.e. the direction running from where it is fitted to the water tub 108 toward the suspension fitting portion 17, forms an angle of $\theta 11$ ($0° < \theta 11 < 90°$) with respect to a horizontal axis running in the front/rear direction. On the other hand, the suspension 54 is so arranged that the direction in which the suspension 54 supports, i.e. the direction running from where it is fitted to the water tub 108 toward the suspension fitting portion 17, forms an angle of $\theta 12$ ($0° < \theta 12 < 90°$) with respect to a horizontal axis running in the front/rear direction. That is, as seen from a side, the suspensions 52 (53) and 54 are so fitted as to be increasingly close to each other upward. Moreover, as shown in FIG.

12, the suspension fitting portion 17 is arranged in front of the center of gravity G6 of the vibrating body load 110, which will be described later. This allows the suspension 52 (53) to more effectively lift the front part of the water tub 108. Moreover, as in the fifth embodiment, as seen from above, the suspensions 52, 53, and 54 are arranged parallel to the front/rear direction of the drum-type washing machine.

In this drum-type washing machine, the structural load 109 is constituted by the water tub 108, the drum 34, the motor 36, the heater portion 40, the heat exchange plate (unillustrated in this embodiment, but arranged on the left of the heater portion 40 as in FIG. 3 of the first embodiment), the blowing fan 42, and the liquid balancer 37. Let g7 represent the center of gravity of the structural load 109, let g2 represent the center of gravity of the laundering load 56 as present when laundry having the rated weighted is put in, and let G6 represent the center of gravity of the vibrating body load 110 constituted by the structural load 109 and the laundering load 56 considered together. Then, as shown in FIG. 12, the dampers 50 and 51 are so arranged as to support behind the center of gravity g7 of the structural load 109. Specifically, this means that the intersection between the vertical plane on which the axes of direction in which the dampers 50 and 51 support lie and the line running from the center of gravity G6 of the vibrating body load 110 toward the center of gravity g7 of the structural load 109 is located behind the position g7.

Moreover, as shown in FIG. 12, the damper 96 is so arranged as to support in front of the center of gravity G6 of the vibrating body load 110. Specifically, this means that the intersection between the axis of direction in which the damper 96 supports and the horizontal plane on which the center of gravity G6 of the vibrating body load 110 lies is located in front of the center of gravity G6 of the vibrating body load 110.

In this drum-type washing machine, the center of gravity of the vibrating body load 110 is located in front of the axis P11-P12. Thus, the front part of the water tub 108 located in front of the axis P11-P12 tends to be displaced downward, and the rear part of the water tub 108 located behind the axis P11-P12 tends to be displaced upward. That is, in the vertical cross-sectional view of FIG. 12 as seen from the right side, the vibrating body load 110 develops a counter-clockwise momentum about the axis P11-P12, and thus the water tub 108 rotates counter-clockwise about the axis P11-P12. In addition to this rotational displacement, the weight of the laundering load 56 acts to make the dampers 50 and 51 contract, causing the water tub 108 as a whole to be displaced further downward. This tends to make the sinking displacement of the front part of the water tub 108 large, making it essential to reduce the sinking of the front part of the water tub 108.

In the drum-type washing machine of the sixth embodiment, as in the fifth embodiment, the rotation of the water tub 108 about the axis P11-P12 and the sinking thereof can be effectively prevented, and in addition the damper 96 reduces the vibrations of the front part of the water tub 108. Thus, even if abnormal vibrations occur, they can be suppressed at an early stage. Furthermore, no member is provided that directly couples the cabinet opening 61*a* and the water tub opening 64*a* together. This helps make the vibrations of the water tub 108 less likely to conduct to the cabinet 60, and helps realize a drum-type washing machine that offers enhanced usability in that the water tub door 65 can surely be opened.

In the drum-type washing machines of the fifth and sixth embodiments, when the laundering load 56 is put in, the center of gravity of the vibrating body load 107 (110) shifts frontward-downward. Accordingly, the dampers 50 and 51 may be so arranged as to support the center of gravity g6 (g7) of the structural load 106 (109). Instead of two dampers 50 and 51 supporting behind the center of gravity g6 (g7) of the structural load 106 (109) and one damper 96 supporting in front of the center of gravity G5 (G6) of the vibrating body load 107 (110), those dampers may be arranged the other way around; specifically, one damper may support behind the center of gravity g6 (g7) of the structural load 106 (109) and two dampers in front of the center of gravity G5 (G6) of the vibrating body load 107 (110). Alternatively, a plurality of dampers may support behind the center of gravity g6 (g7) of the structural load 106 (109) and a plurality of dampers in front of the center of gravity G5 (G6) of the vibrating body load 107 (110). Alternatively, one damper may support behind the center of gravity g6 (g7) of the structural load 106 (109) and one damper in front of the center of gravity G5 (G6) of the vibrating body load 107 (110).

In the drum-type washing machines of the embodiments of the present invention, two suspensions support the front part of the water tub, and one suspension supports the rear part of the water tub. Alternatively, those suspensions may be arranged the other way around; specifically, one suspension may support the front part of the water tub and two suspensions the rear part of the water tub. Alternatively, a plurality of suspensions may support the front part of the water tub and a plurality of suspensions the rear part of the water tub. In a case where no consideration needs to be given to left/right-direction vibrations of the water tub, one suspension may support the front part of the water tub and one suspension the rear part of the water tub.

In the drum-type washing machines of the embodiments of the present invention, it is advisable that, with respect to a horizontal plane, the angle ($\theta 1$, $\theta 3$, $f5$, $\theta 7$, $\theta 9$, and $\theta 11$) formed by the axis of direction in which the suspension supporting the front part of the water tub elastically supports be larger than the angle ($\theta 2$, $\theta 4$, $\theta 6$, $\theta 8$, $\theta 10$, and $\theta 12$) formed by the axis of direction in which the suspension supporting the rear part of the water tub elastically supports. This allows the front part of the washing machine to be lifted more effectively, and helps reduce the sinking of the front part of the water tub. It is advisable that the spring constant of the suspension supporting the front part of the water tub be greater than the spring constant of the suspension supporting the rear part of the water tub. This too allows the front part of the washing machine to be lifted more effectively, and helps reduce the sinking of the front part of the water tub.

In the drum-type washing machines of the embodiments of the present invention, the front part of the water tub is supported by being suspended with two suspensions and the front part of the water tub is supported by being suspended with one suspension. The water tub may be supported by being suspended in any other manner. For example, the front part of the water tub may be supported by being suspended with one suspension and the rear part of the water tub by being suspended with one suspension. Alternatively, the front part of the water tub may be supported by being suspended with one suspension and the rear part of the water tub by being suspended with two suspensions. Alternatively, the front and rear parts of the water tub may each be supported by being suspended with a plurality of suspensions.

The two dampers that support the water tub in the first to fourth embodiments, and the two dampers that support the rear part of the water tub in the fifth and sixth embodiments (i.e. the dampers 50 and 51 in the embodiments of the present invention) are so fitted as to be increasingly close to each other upward. Those two dampers may be so fitted as to be vertical as seen from in front. The one damper that supports the front part of the water tub in the fifth and sixth embodiments (i.e. the damper 96 in the embodiments) is so fitted as to be vertical as seen from a side. It may be so fitted that the water-tub-side damper fitting portion (the damper fitting portion 105 in the embodiments) is located behind the bottom-stand-side damper fitting portion (the damper fitting portion 99 in the embodiments); that is, with respect to a horizontal axis running in the front/rear direction, the direction in which one damper supporting the front part of the water tub is fitted may form an angle greater than 0 degrees and smaller than 90 degrees.

In the drum-type washing machines of the embodiments of the present invention, the suspension fitting portion 23 (24) or the suspension fitting portion 67 (68) is filled to the outer circumferential surface of the water tub (see FIGS. 2, 6, 7, 8, 9, and 12); it may be fitted in the front side of the water tub, like the suspension fitting portion 23' (24') or the suspension fitting portion 67' (68') (see FIGS. 2, 6, 7, 8, 9, and 12). By relocating, from the outer circumferential surface of the water tub to the front part thereof, the water-tub-side suspension fitting portion of the suspension supporting the front part of the water tub, it is possible to increase the front/rear-direction distance between the water-tub-side supporting position of the suspension supporting the front part of the water tub and the water-tub-side supporting position of the damper. This makes it possible to support, by suspending, the front part of the water tub with a weak tensile force.

In the drum-type washing machines of the embodiments of the present invention, the fitting portions for fitting suspensions or dampers to the water tub may be provided integrally with the water tub. This helps reduce the number of components and reduce cost. The fitting positions at which suspensions for supporting the front and rear parts of the water tub are fitted to the cabinet may be arranged substantially in a row in the left/right direction. This helps reduce the front/rear-direction width of the cabinet-side suspension fitting portions, and thus helps make the suspension fitting portions compact and lightweight.

In the drum-type washing machines of the embodiments of the present invention, the dampers not only support elastically but also exert a damping effect. Part or all of the dampers may be dissociated from a damping effect, and instead part or all of the suspensions may be designed to exert a damping effect. For example, in the first to fourth embodiments, the dampers may be dissociated from a damping effect, and instead the suspensions may be designed to exert a damping effect. In the fifth or sixth embodiment, the damper supporting the rear part of the water tub may be designed to exert a damping effect, while the dampers and suspensions supporting the front part of the water tub may be dissociated from a damping effect. Alternatively, in the fifth or sixth embodiment, all the dampers ay be dissociated from a damping effect, and instead the suspensions may be designed to exert a damping effect.

INDUSTRIAL APPLICABILITY

The present invention is applicable to drum-type washing machines provided with a water tub having a drum contained inside it.

The invention claimed is:

1. A drum-type washing machine comprising:

a cabinet having a cabinet opening open frontward, the cabinet having a top plate on a top surface thereof;

a water tub arranged inside the cabinet and having a water tub opening open toward the cabinet opening, the water tub arranged so that a rear part thereof is inclined downward with respect to a horizontal plane;

a drum contained inside the water tub and having a drum opening open toward the water tub opening;

a motor for driving the drum to rotate;

a suspending device for elastically supporting, from above, the water tub inside the cabinet; and a damping device for elastically supporting, from below, the water tub inside the cabinet, wherein the damping device has a first damper that supports the water tub from below by pressing it upward, and the suspending device has a first suspender that supports from above, by suspending upward-rearward, a front part of the water tub located in front of a position where the water tub is supported by the first damper, and the suspending device further has a second suspender that supports from above, by suspending upward-forward, a rear part of the water tub located behind the position where the water tub is supported by the first damper, a suspension fitting portion which is arranged in a central part of the bottom surface of the top plate, the suspension fitting portion being located behind and above the location where the first suspender is fitted with the water tub, and in front of and above the location where the second suspender is fitted with the water tub.

2. The drum-type washing machine of claim 1, wherein the water tub opening and the cabinet opening are located away from each other without being directly coupled together by any member.

3. The drum-type washing machine of claim 1, wherein with respect to a structural load composed of the water tub, the drum, and the motor and elastically supported inside the cabinet by the suspending device and the damping device, a laundering load composed of laundry, having a rated weight and placed inside the water tub, and washing water, and a vibrating body load composed of the structural load and the laundering load, the damping device supports between a center of gravity of the structural load and a center of gravity of the vibrating body load.

4. The drum-type washing machine of claim 1, wherein with respect to a structural load composed of the water tub, the drum, and the motor and elastically supported inside the cabinet by the suspending device and the damping device, a laundering load composed of laundry, having a rated weight and placed inside the water tub, and washing water, and a vibrating body load composed of the structural load and the laundering load, the damping device supports at a center of gravity of the structural load.

5. The drum-type washing machine of claim 1, wherein with respect to a structural load composed of the water tub, the drum, and the motor and elastically supported inside the cabinet by the suspending device and the damping device, a laundering load composed of laundry, having a rated weight and placed inside the water tub, and washing water, and a vibrating body load composed of the structural load and the laundering load, the damping device supports at a center of gravity of the vibrating body load.

6. The drum-type washing machine of claim 1, wherein the damping device has a second damper that supports, by pressing upward, the front part of the water tub located in front of the position where the water tub is supported by the first damper.

7. The drum-type washing machine of claim 6, wherein with respect to a structural load composed of the water tub, the drum, and the motor and elastically supported inside the cabinet by the suspending device and the damping device, a laundering load composed of laundry, having a rated weight and placed inside the water tub, and washing water, and a vibrating body load composed of the structural load and the laundering load, the second damper supports at a position in front of a center of gravity of the vibrating body load.

8. The drum-type washing machine of claim 1, wherein the first and second suspenders are so arranged that, with respect to a horizontal plane, an axis of direction in which the first suspender supports forms a larger angle than an axis of direction in which the second suspender supports.

9. The drum-type washing machine of claim 1, wherein the first suspender has a greater spring constant than the second suspender.

10. The drum-type washing machine of claim 1, wherein the first suspender has a stopper that prevents the front part of the water tub from being displaced downward beyond a predetermined distance.

11. The drum-type washing machine of claim 10, wherein the first suspender includes a coil spring for elastic supporting, and the stopper functions as a result of mutual contact among adjacent turns of wire forming the coil spring included in the first suspender.

12. The drum-type washing machine of claim 1, wherein the cabinet has a soft member provided at a lower-edge part of the cabinet opening.

13. The drum-type washing machine of claim 1, wherein at least one of portions at which the damping device and the suspending device are fitted to the water tub is formed integrally therewith.

* * * * *